US006688232B2

(12) United States Patent
Griesbach et al.

(10) Patent No.: US 6,688,232 B2
(45) Date of Patent: Feb. 10, 2004

(54) COMPRESSED POWDER CHARGE FOR MUZZLELOADER AND BLACK POWDER FIREARMS

(75) Inventors: Mark Andrew Griesbach, Hortonville, WI (US); Brett Neal Epstein, Boca Raton, FL (US)

(73) Assignee: Legend Products Corporation, Boca Raton, FL (US)

( * ) Notice: Subject to any disclaimer, the term of this patent is extended or adjusted under 35 U.S.C. 154(b) by 0 days.

(21) Appl. No.: 10/331,025

(22) Filed: Dec. 27, 2002

(65) Prior Publication Data

US 2003/0121441 A1 Jul. 3, 2003

Related U.S. Application Data

(60) Provisional application No. 60/345,736, filed on Dec. 31, 2001.

(51) Int. Cl.[7] ..... C06D 5/06
(52) U.S. Cl. ..... 102/288; 102/283
(58) Field of Search ..... 102/283, 288; 42/51

(56) References Cited

U.S. PATENT DOCUMENTS

| | | | | |
|---|---|---|---|---|
| 321,042 | A | 6/1885 | Lyman | |
| 2,575,871 | A | 11/1951 | Gordon et al. | 102/98 |
| 2,632,391 | A | 3/1953 | Kintzinger | 102/38 |
| 3,008,258 | A | 11/1961 | Johnson | 42/14 |
| 3,396,661 | A | 8/1968 | Michael | 102/103 |
| 3,398,684 | A | 8/1968 | Kvavle | 102/49.3 |
| 3,513,776 | A | 5/1970 | Driscoll | 102/38 |
| 3,557,700 | A | 1/1971 | Quinlan | 102/38 |
| 3,648,616 | A | 3/1972 | Hsu | 102/40 |
| 3,670,649 | A | 6/1972 | Hartlein et al. | 102/38 |
| 3,754,510 | A | 8/1973 | Marondel et al. | 102/101 |
| 3,901,153 | A | 8/1975 | Brabets et al. | 102/38 |
| 3,994,235 | A | 11/1976 | Politzer et al. | 102/101 |
| 4,128,443 | A | 12/1978 | Pawlak et al. | 149/71 |

(List continued on next page.)

OTHER PUBLICATIONS

Golden Powder Brand Brochure, (2 pgs.), 1985.
Rottweil Black Powder Brochure, (1 pg.) Circa 1980s.
Legend Products Business Plan, (52 pgs.), 1991.
*Guns* Magazine (Jul. 1984), (1pg.).
*Guns* Magazine (Aug. 1984), (7pgs.).

*Primary Examiner*—Michael J. Carone
*Assistant Examiner*—Aileen B. Felton
(74) *Attorney, Agent, or Firm*—Davis & Bujold, P.L.L.C.

(57) ABSTRACT

A clean burning premeasured compressed charge for use in black powder firearms as well as cartridges. The premeasured compressed charge is manufactured to have a substantially desired shape which facilitates improved flame propagation by the leading end wall and along the exposed sidewall surfaces of the compressed charge to result in a more complete and rapid burning of the compressed charge both from the leading end wall toward the trailing end wall and also radially inwardly from each one of the four sidewalls toward a center of the premeasured compressed charge. The premeasured compressed charge has a leading end portion and a trailing end portion and the leading end portion is either the same size or a smaller dimension than the trailing end portion.

37 Claims, 16 Drawing Sheets

U.S. PATENT DOCUMENTS

| | | | | |
|---|---|---|---|---|
| 4,187,781 | A | 2/1980 | Flanagan et al. | 102/38 |
| 4,282,813 | A | 8/1981 | Sterbutzel | 102/431 |
| 4,497,676 | A | 2/1985 | Kurtz | 149/2 |
| 4,702,167 | A | 10/1987 | Reinelt et al. | 102/282 |
| 4,724,017 | A | 2/1988 | Eich et al. | 149/11 |
| 4,728,376 | A | 3/1988 | Kurtz | 149/21 |
| 4,759,885 | A | 7/1988 | Kurtz | 264/3.1 |
| 4,864,932 | A | 9/1989 | Reinelt et al. | 102/282 |
| 4,964,929 | A | 10/1990 | Beyeler et al. | 149/109.6 |
| 4,994,203 | A | 2/1991 | Lefumeux et al. | 252/12.2 |
| 4,997,496 | A | 3/1991 | Wehrli | 149/18 |
| 5,063,851 | A | 11/1991 | Moscrip | 102/433 |
| 5,133,240 | A | 7/1992 | Thiesen et al. | 86/20.14 |
| 5,269,224 | A | 12/1993 | Gonzales et al. | 102/288 |
| 5,282,423 | A | 2/1994 | Sikorski et al. | 102/431 |
| 5,421,264 | A | 6/1995 | Petrick | 102/443 |
| 5,449,423 | A | 9/1995 | Cioffe | 149/19.1 |
| 5,465,664 | A | 11/1995 | Fey | 102/290 |
| 5,557,151 | A | 9/1996 | Epstein et al. | 264/3.4 |
| 5,569,875 | A | 10/1996 | Fey | 149/61 |
| 5,633,476 | A | 5/1997 | Cioffe | 149/109.6 |
| 5,726,378 | A | 3/1998 | Barrett | 102/288 |

COMPRESSED POWDER CHARGE FOR MUZZLELOADER AND BLACK POWDER FIREARMS

This application claims the benefit of provisional 60/345,736 filed on Dec. 31, 2001.

FIELD OF THE INVENTION

The present invention relates to an improved premeasured compressed charge for use in muzzleloading and black powder firearms.

BACKGROUND OF THE INVENTION

An important aspect when using a traditional muzzleloading or black powder firearm is to facilitate quick, reliable and consistent reloading of the firearm following discharge. As is conventionally known in the art, a desired volume of gun powder propellent is supplied to either the muzzle end or the breech end of the barrel of a gun, depending on the design of the firearm. During loading of a muzzleloading firearm, the charge, the sabot or patch (wad), if necessary, and the projectile, in that order, are all loaded through the discharging end of the barrel-sometimes the sabot or patch (wad) may be omitted. The contents are typically packed toward the breech end of the firearm using a ramrod to ensure a consistent loading and seating pressure of the propellant and the projectile and the seating reduces the chances of an inadvertent blow up of the barrel of the firearm because of an air gap formed between the propellant and the projectile.

As is well known in the art, the propellent was typically a loose granular gunpowder, e.g., a mixture of charcoal, potassium nitrate and sulfur. Early powders were dangerous to handle and tended to foul the bore of the firearm. That is, after one or more firings of the firearm, the user would typically have to clean the bore of the barrel using a device which scrapes or wipes the inner bore surface of the barrel. If such cleaning was not periodically performed or performed improperly, the interior bore of the barrel build-ups a layer of residue of unconsumed propellent and such residue can lead to corrosion and/or malfunctioning of the firearm and clogging of the ignition or flash channel. For a number of years, black powder was the only propellent used in muzzleloading firearms, and eventually black powder substitutes, such as those sold under the trade names PYRODEX, BLACK CANYON, CLEAN SHOT and AMERICAN PIONEER, are now commonly utilized. For at least the past 25 years, black powder and black powder substitutes have been pelletized to facilitate ease of loading of firearms.

SUMMARY OF THE INVENTION

Wherefore, it is an object of the present invention to overcome the above mentioned shortcomings and drawbacks associated with the prior art propellent charges used with muzzleloading firearms.

Another object of the present invention is to design a premeasured compressed charge which has a substantially square transverse cross-section which slightly tapers or expands from a smaller dimension leading portion to a wider dimension trailing portion.

A further object of the present invention is to design a premeasured compressed charge which traps ambient air within the breech end of the barrel, following loading of the barrel with the premeasured compressed charge and a slug or bullet to be discharged by the firearm, so that the trapped air facilitates a more complete and rapid burning of the powder and thereby minimizes the amount of unburned or unconsumed particles of powder which remain in the barrel, following discharge, thereby reducing the likelihood that any unburned or unconsumed particles may later cause a malfunction of the firearm, e.g. inadvertent ignition when reloading, blockage of the flash channel or restricting loading of a projectile.

Another object of the invention is to provide a premeasured compressed charge which facilitates propagation of the flame, generated by the percussion cap or other ignition device, and assists with directing this propagated flame over the entire smaller dimension leading end wall of the premeasured compressed charge as well as along the sidewalls of the premeasured compressed charge to facilitate a faster and better ignition of the premeasured compressed charge upon discharge of the firearm, i.e. the premeasured compressed charge burns axially from the smaller dimension leading end wall or portion toward the wider dimension trailing end wall or portion as well as radially inwardly from each one of the sidewalls toward a longitudinal axis extending through the center of the premeasured compressed charge.

Yet another object of the present invention is to provide a premeasured compressed charge which, upon inserting the premeasured compressed charge inside an adequately sized bore of a barrel of a firearm, is designed to cause a small percentage of the charge, e.g., a fraction of a percent to about five percent or so, to be removed or shaved from the premeasured compressed charge by the barrel of the firearm so that the shaved off powder typically falls toward the breech end of the barrel. The removed or shaved powder, should fall adjacent to the breech end of the barrel to improve the flame intensity at the outlet of the flash channel, supplied by the percussion cap (or other igniting device such as a musket cap, a flint, etc.), and facilitates a more rapid burning of the premeasured compressed charge. If the side walls of the premeasured compressed charge do not taper, than a small fraction of a percent will generally not be removed or shaved from the premeasured compressed charge by the barrel of the firearm and fall toward the breech end of the barrel.

Still another object of the present invention is to provide a premeasured compressed charge which will be centered and captively received within the breech end of the bore of the firearm, due to the interference fit between the premeasured compressed charge and the bore of the barrel, to minimize any lateral movement or shifting of the premeasured compressed charge once loaded within the barrel.

A further object of the present invention is to taper slightly a leading end portion of the premeasured compressed charge so that the tapered leading end portion of the premeasured compressed charge is located closely adjacent an outlet, of the flash channel, to facilitate a more reliable, quicker and complete ignition of the premeasured compressed charge and better flame propagation, e.g., to space the tapered leading end wall closer to the outlet of the flash channel than possible with prior art designs.

A still further object of the present invention is ensure complete burning of the propellent charge, following ignition but prior to discharging the projectile out the muzzle end of the firearm, to minimize the possibility of discharging any unburnt particles of the propellent charge out the muzzle end of the firearm, i.e., to not result in "rocketing" of the premeasured compressed charge out the muzzle end of the firearm. The elimination, or minimization at the very least, of any unburnt particles, in turn, facilitates a shorter time span that the end user must wait prior to safely reloading the firearm with a further premeasured compressed charge for a subsequent firing of the firearm. The elimination or minimization of unburnt particles also ensures better accuracy and consistency when using the firearm.

Yet another object of the present invention is ensure a quicker and more complete ignition of the propellent charge to facilitate use of the premeasured compressed charge in "short barrel" rifles and pistols.

Still another object of the present invention is to taper at least three of the sidewalls, and possibly all four sidewalls, of the propellent charge, from the smaller dimension leading portion to the wider dimension trailing portion.

A further object of the present invention is to increase the exposed sidewall surface area of the compressed charge to facilitate a more rapid and complete burning of the compressed charge upon discharging the firearm.

A further object of the present invention is to design a premeasured compressed charge which has a substantially square transverse cross-section which slightly tapers or expands from a smaller dimension leading portion to a wider dimension trailing portion with both portions sized to be received within the barrel without either the smaller dimension leading portion or the wider dimension trailing portion having an interference fit with the bore of the firearm.

The present invention also relates to an improved premeasured compressed charge for use with a black powder firearm having a desired caliber, the premeasured compressed charge having a leading end portion and a trailing end portion, the leading end portion having a smaller diagonal dimension than both the trailing end portion and the desired caliber of the firearm, while the trailing end portion having a larger diagonal dimension than the desired caliber of the firearm such that the leading end portion of the premeasured compressed charge is readily received within the desired caliber of the firearm while the trailing end portion must be forced into the desired caliber of the firearm; wherein the leading end portion of the premeasured compressed charge is located closely adjacent an outlet of the flash channel of the firearm, following loading of the premeasured compressed charge within the firearm, and the leading end portion facilitates better flame propagation of the flame along sidewalls of the premeasured compressed charge, generated upon detonation of an ignition device, to facilitate the more complete combustion of the premeasured compressed charge and less rocketing of the premeasured compressed charge following discharge of the projectile from the muzzle end of the firearm.

The present invention also relates to an improved premeasured compressed charge for use with a black powder firearm having a desired caliber, the premeasured compressed charge having a leading end portion and a trailing end portion, the leading end portion having a smaller diagonal dimension than both the trailing end portion and the desired caliber of the firearm, while the trailing end portion having a smaller diagonal dimension than the desired caliber of the firearm such that both the leading end portion and the trailing end portion of the premeasured compressed charge are received within the desired caliber of the firearm; wherein the leading end portion of the premeasured compressed charge is located closely adjacent an outlet of the flash channel of the firearm, following loading of the premeasured compressed charge within the firearm, and the leading end portion facilitates better flame propagation of the flame along sidewalls of the premeasured compressed charge, generated upon detonation of an ignition device, to facilitate the more complete combustion of the premeasured compressed charge and less rocketing of the premeasured compressed charge following discharge of the projectile from the muzzle end of the firearm.

In the following description and the appended claims, the term "ignition device" is used to generally indicate one of a percussion cap, a musket cap, a flint, etc., or some other discharging or igniting device for a muzzleloader or a black powder firearm.

BRIEF DESCRIPTION OF THE DRAWINGS

The invention will now be described, by way of example, with reference to the accompanying drawings in which.

DETAILED DESCRIPTION OF THE INVENTION

Figure 1:
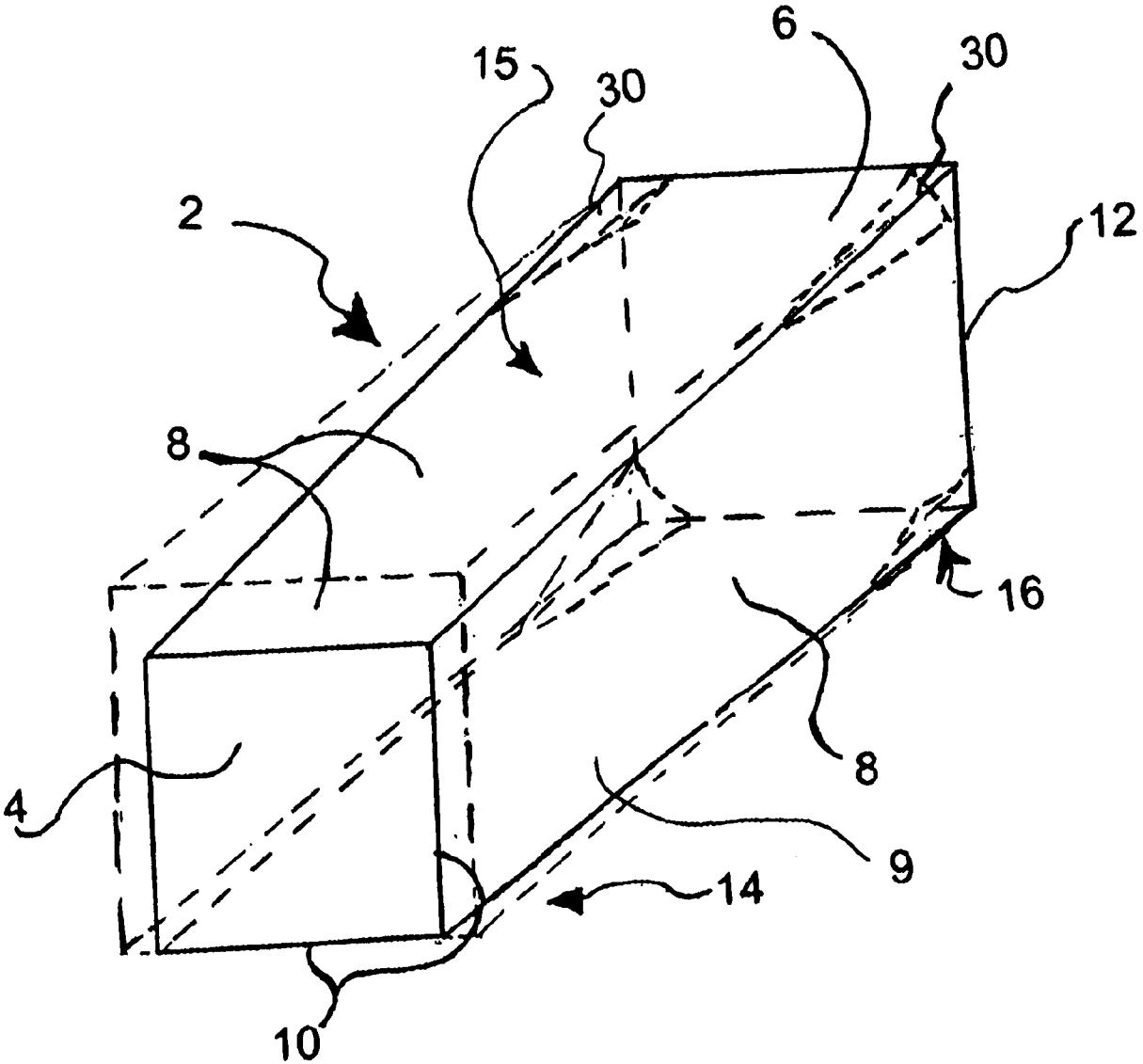
FIG. 1 is a diagrammatic perspective view of a first embodiment of a premeasured compressed charge according to the present invention.
Figure 2:
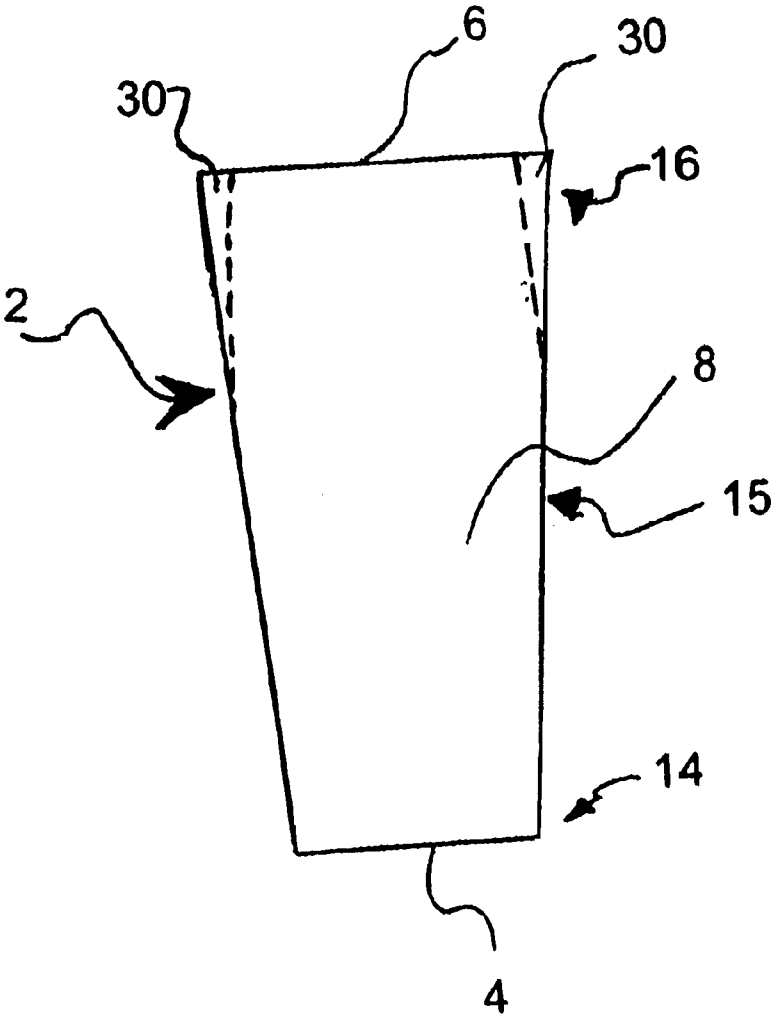
FIG. 2 is a diagrammatic side elevational view of the premeasured compressed charge of FIG. 1.
Figure 3:
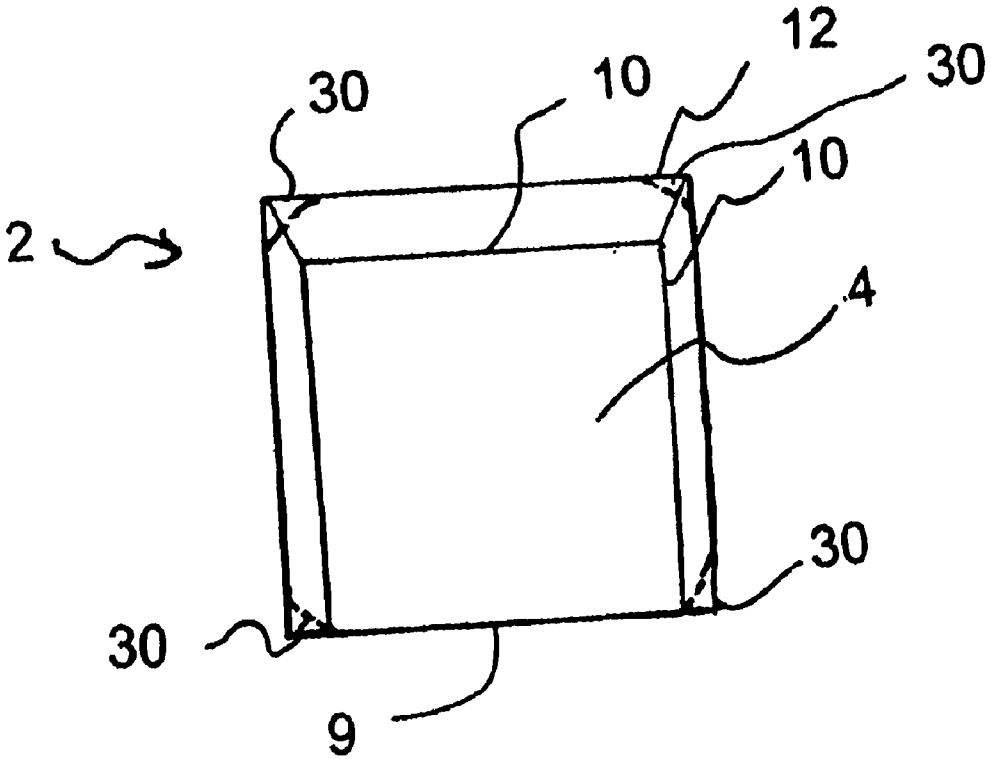
FIG. 3 is a diagrammatic front elevational view of the premeasured compressed charge of FIG. 1.

Turning now to FIGS. 1–3, a detailed description concerning the improved premeasured compressed charge 2 will now be provided. As can be seen in FIG. 1, the premeasured compressed powder charge 2 comprises a pair of substantially planar end walls 4, 6 which are both generally rectangular or square in shape. The leading end wall 4 has a dimension which is less than the inside diameter of the barrel for which it is designed, e.g., for a 50-caliber barrel the leading end wall 4 has a diagonal measurement of between 0.44 and 0.47 inches and preferrably about 0.45 inches or so, while the trailing end wall 6 has a dimension greater than the inside diameter of the barrel for which it is designed, e.g., oversized by between 0.001 and 0.040 inches and preferrably about 0.010 inches, that is, for a 50-caliber barrel the trailing end wall 6 has a diagonal measurement of approximately 0.501 and 0.540 inches and preferrably about 0.510 inches. Three substantially planar and slightly tapering sidewalls 8 interconnect a common perimeter region or edge 10 of the leading end wall 4 with a common region or edge 12 of the trailing end wall 6. That is, the three tapering sidewalls 8 form an acute angle with the trailing end wall 6 and form an obtuse angle with the leading end wall 4. A fourth substantially planar sidewall 9 interconnects the remaining region or edge 10 of the leading end wall 4 with the remaining region or edge 12 of the trailing end wall 6. The fourth substantially planar sidewall 9 does not taper in this embodiment. That is, the fourth substantially planar sidewall 9 extends or lies normal to both the leading end wall 4 and the trailing end wall 6.

As a result of this configuration, for a 50-caliber firearm, an 80 grain velocity equivalent charge of the premeasured compressed charge 2 (approximate weight of 64–75 grains) generally has an axial longitudinal length of between 1.4 inches and 1.7 inches, a 50 grain velocity equivalent charge of the premeasured compressed charge 2 (approximate weight of 40–45 grains) generally has an axial longitudinal length of between 0.9 and 1.1 inches, and a 30 grain velocity equivalent charge of the premeasured compressed charge 2 (approximate weight of 24–27 grains) generally has an axial longitudinal length of between 0.65 and 0.75 inches. For a 45-caliber firearm, a 50 grain velocity equivalent charge of the premeasured compressed charge 2 (approximate weight of 40–45 grains) generally has an axial longitudinal length of between 1.05 and 1.15 inches, and a 30 grain velocity equivalent charge of the premeasured compressed charge 2 (approximate weight 24–27 grains) generally has an axial longitudinal length of between 0.75 and 0.85 of an inch. In short, it is possible to manufacture compressed charges anywhere from about 10 grains to about 250 grains by weight. Accordingly, the axial longitudinal and radial dimensions of the premeasured compressed charge 2 can vary from application to application, depending upon a number of factors, e.g., the diameter of the barrel, the size of the projectile to be discharge, the desired exit velocity of the projectile, etc. Typically, the diagonal dimension of the leading end portion is between 0.31 of an inch and 0.53 of an inch and the diagonal dimension of the trailing end portion is between 0.37 of an inch and 0.59 of an inch.

The premeasured compressed charge 2 is generally a solid unitary structure of a chemical mixture of a propellant, possibly black powder. Preferably the propellent, according to the present invention, is a black powder substitute containing a mixture of potassium perchlorate, potassium nitrate, a fuel component such as an amino acid or a carbohydrate, e.g., ascorbic acid, sugar, starch, etc., and charcoal (carbon). It is to be appreciated that any other black powder substitute, particularly those containing a fuel component from the carbohydrate family (e.g, sugar, starch, etc.) as a partial or complete substitute for the ascorbic acid fuel component, will also function well. Sugar, according to the present invention, is intended to cover, for example, glucose, fructose, dextrose, lactose, simple sugars, etc. Starch, according to the present invention, is intended to cover, for example, rice starch, potato starch, dextrin, etc. One preferred formula for the premeasured compressed charge comprises a mixture of: 15–35% by weight of potassium perchlorate; 25–50% by weight of potassium nitrate; 25–50% by weight of a fuel component (such as ascorbic acid or some other carbohydrate family composition(s)); and 0–5% by weight of charcoal. A second preferred formula for the premeasured compressed charge comprises a mixture of: 50–75% by weight of potassium nitrate; 25–50% by weight of a fuel component (such as amino acid, ascorbic acid or some other carbohydrate family composition(s)); and 0–5% by weight of charcoal.

Although the above formulas are preferred propellants for use in manufacturing the premeasured compressed charge 2, it is to be appreciated that other currently available types or brands of black powder and/or black powder substitutes can be used to manufacture the premeasured compressed charge 2 without departing from the spirit and scope of the present invention.

Figure 4:
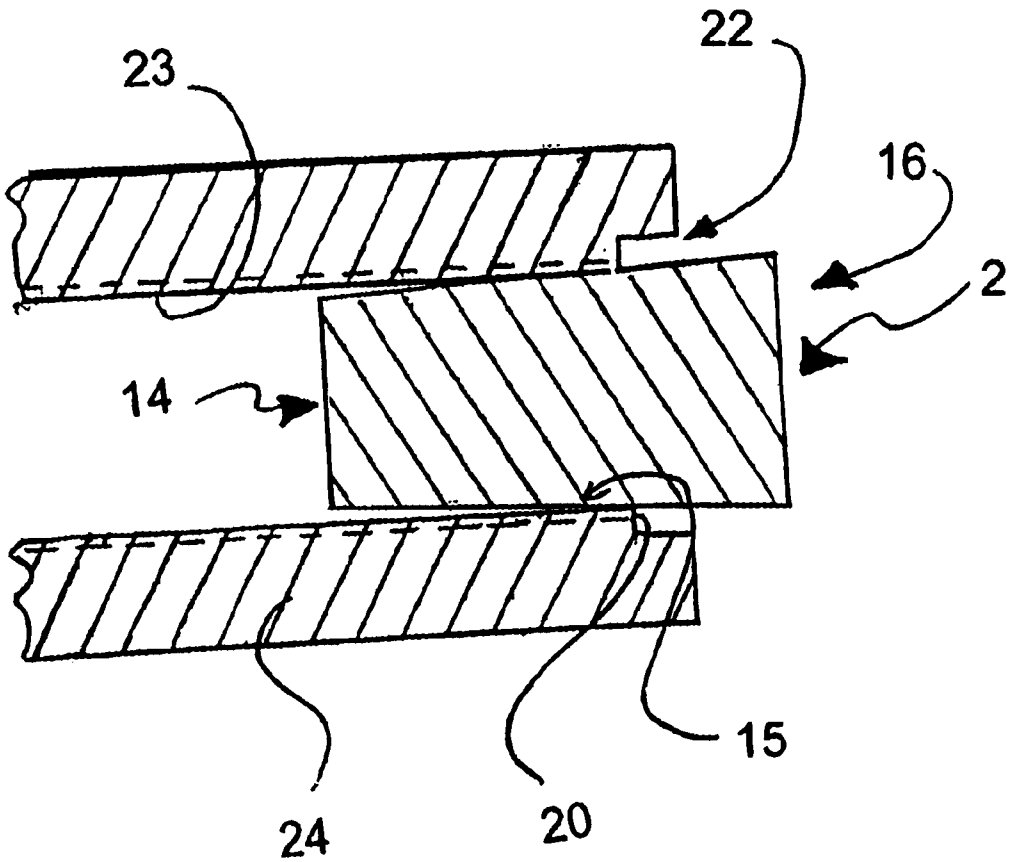
FIG. 4 diagrammatically shows the initially loaded position of the premeasured compressed charge of FIG. 1 in the muzzle end of the barrel.

It is to be appreciated that the barrel of a 50-caliber firearm typically has a nominal bore 26 dimension of about 0.500 of an inch. As such, when an end user places the premeasured compressed charge 2, according to the present invention, within the muzzle end 22 of the barrel (see FIG. 4), the leading end portion 14 of the premeasured compressed charge 2 is readily received therein until an intermediate portion 15 of the four sidewalls 8, 9 abuts with an inwardly facing annular perimeter edge surface 20 of the muzzle end 22 of the barrel 24. Such abutting engagement prevents further free unrestricted movement of the premeasured compressed charge 2 into the muzzle end 22 of the barrel 24. The engagement (i.e., contact) results from the oversizing or interference fit of the trailing edge end portion 16 of the premeasured compressed charge 2, which has a diameter dimension of approximately 0.501 and 0.540 inches and preferably about 0.510 of an inch which is attempted to be inserted within the 50-caliber firearm typically having a nominal dimension of about 0.500 inches. As a result of such oversizing or interference fit, the end user has to exert a slight force on the trailing end wall 6 of the premeasured compressed charge 2 to force the compressed charge completely within the muzzle end 22 of the barrel 24, e.g., insertion of the compressed charge within the muzzle end 22 of the barrel 24 about an inch or so to provide sufficient room to accommodate a desired projectile.

Figure 5:
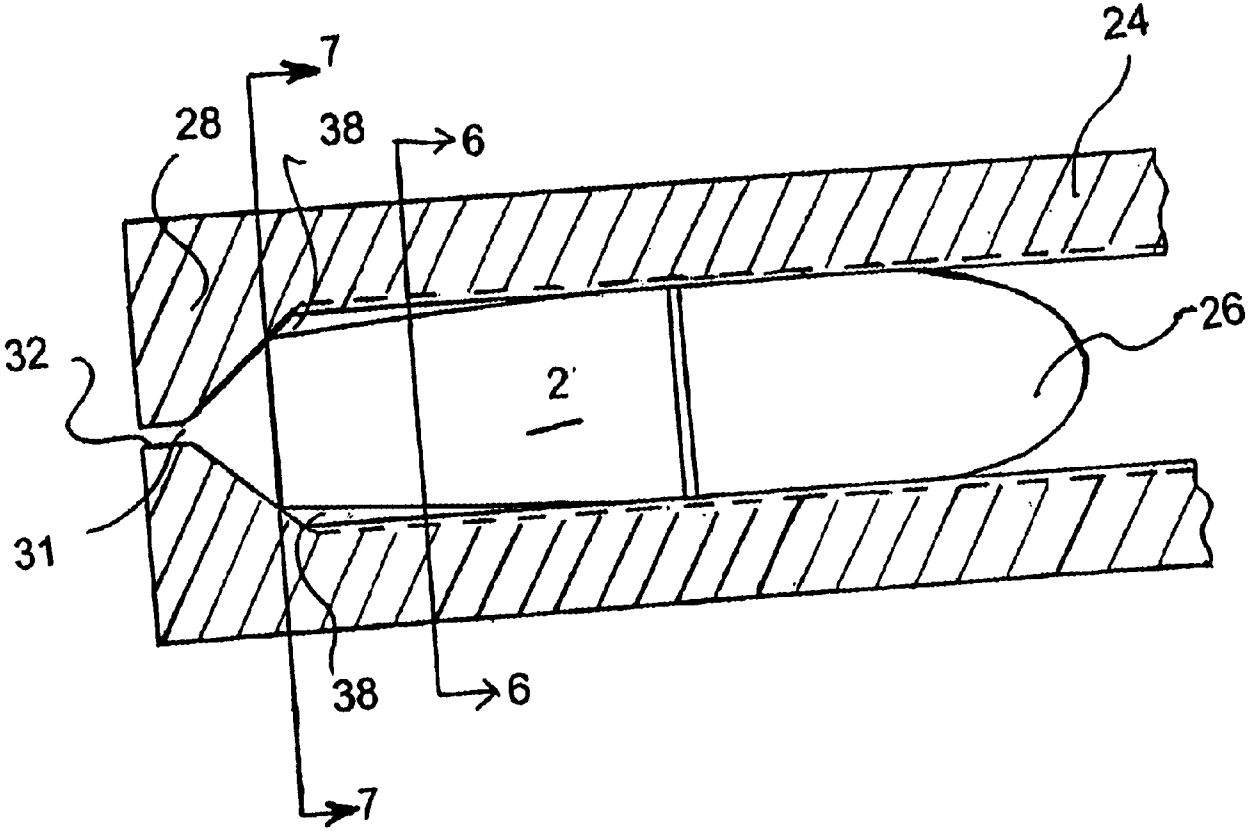
FIG. 5 diagrammatically shows the loaded end position of the premeasured compressed charge of FIG. 1 in the breech end of the barrel adjacent the flash channel.
Figure 6:
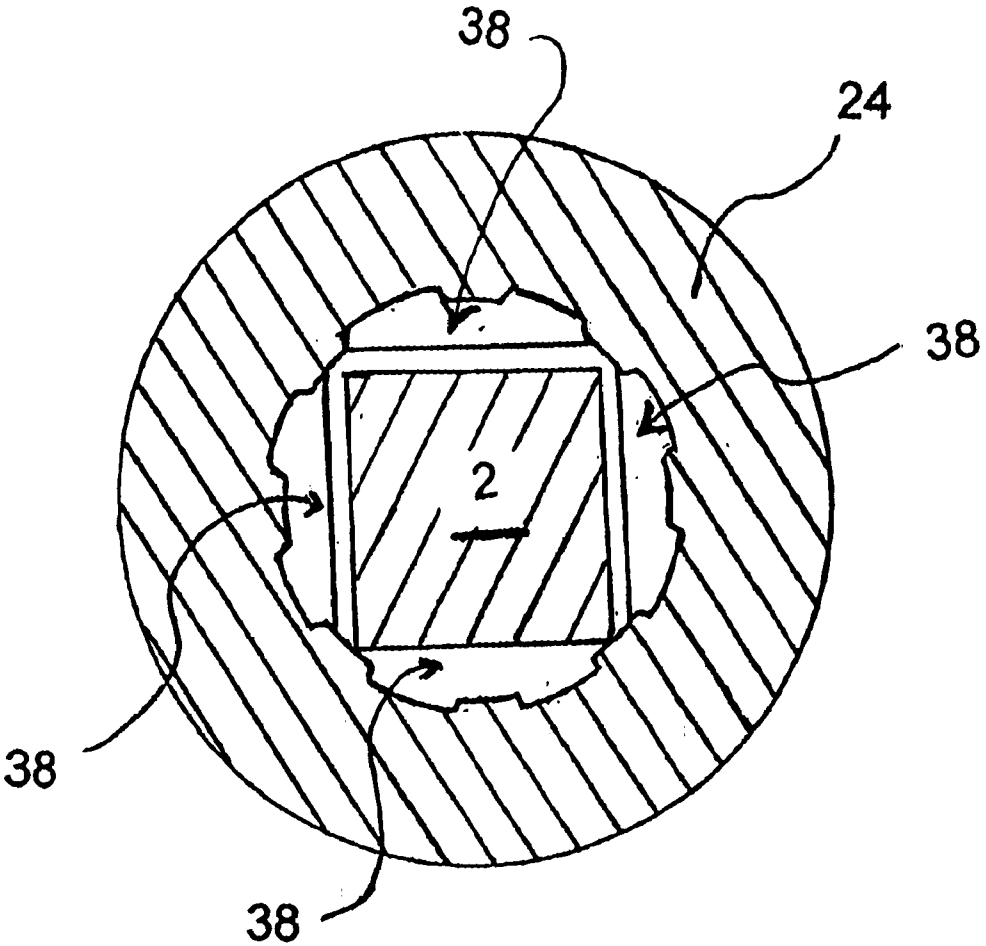
FIG. 6 is a diagrammatic cross-sectional view of the loaded gun barrel along section line 6—6 of FIG. 5.

Once the premeasured compressed charge 2 has been sufficiently forced into the muzzle end 22 of the muzzle-loader barrel 24, e.g. by about an inch or so, to provide sufficient space for insertion of a desired bullet or projectile 26, the end user will then insert the bullet or projectile 26, and possibly a sabot or patch (wad), within the muzzle end of the barrel and "ram" the bullet or projectile 26, along with the previously loaded propellent charge(s) 2 and, if necessary the sabot or patch (wad), toward the breech end 28 of the barrel 22 such that the leading end wall 4 of the propellant charge 2 is positioned adjacent the outlet 31 of the flash channel 32 (see FIG. 5). While the above description only references loading of a single propellent charge 2, it is to be appreciated that two or more propellent charges 2 may be loaded within the muzzle end 22 of the barrel 24 prior to insertion of the desired bullet or projectile 26, and possibly a sabot or patch (wad), to achieve a desired charge within the barrel 24.

During insertion of the premeasured compressed charge 2 into the muzzle end 22 of the barrel 24, four small triangular wedge-shaped sections 30 (see FIGS. 1–3) are generally shaved off or removed from the premeasured compressed charge 2. These four small triangular wedge-shaped sections 30 comprise elongate narrow triangular wedges which commence at the intermediate portion 15 and extend toward the trailing end wall 6 of the premeasured compressed charge 2. Each small triangular wedge-shaped section 30 is removed or shaved off from the premeasured compressed charge 2, due to the interference fit between the premeasured compressed charge 2 and the internal diameter of the bore 23 of the firearm, and the shaved off or removed powder typically falls into the barrel and drops toward the breech end 28 thereof due to gravity. This shaved off or removed loose powder is located closely adjacent to the outlet 31 of the flash channel 32 of the firearm. Upon discharge of the firearm, this loose powder quickly ignites and intensifies the ignition, and possibly the heat, supplied through the flash channel 32 by the percussion cap, or some other conventional ignition device, to facilitate a more rapid burning of the premeasured compressed charge 2.

The shaving of the four longitudinal edges of the premeasured compressed charge 2, from the intermediate portion 15 to the trailing end wall 6, reshapes the longitudinal edges and these reshaped elongate longitudinal edges of the premeasured compressed charge 2 facilitate maintaining the premeasured compressed charge 2 precisely centered within the bore 23 of the barrel as the premeasured compressed charge 2 is loaded into the barrel toward the breech end 28 by a ram-rod in a conventional manner following insertion of the desired bullet or projectile 26. The centering function of the premeasured compressed charge 2, resulting from the interference fit and the shaving of the four longitudinal edges, also traps additional air in the breech end 28 of the barrel 24 and this air further assists with a more efficient and complete burning of the premeasured compressed charge 2 during discharge of the firearm. Preferably each shaved small triangular wedge-shape section 30 will have a weight of between 0.001 and 1.25 grains (a total of no more than 5 grains). The shaved off powder tends to settle between the premeasured compressed charge 2 and the internal diameter of the bore 23 of the firearm providing a loose granular combustion source which is located closely adjacent to the outlet 31 of the flash channel 32 and is readily ignited by the flame emitted through the flash channel 32 upon detonation of the percussion cap, or other ignition device. The loose granular combustion source facilitates a better ignition of the premeasured compressed charge 2 and improves the flame propagation.

Figure 7:
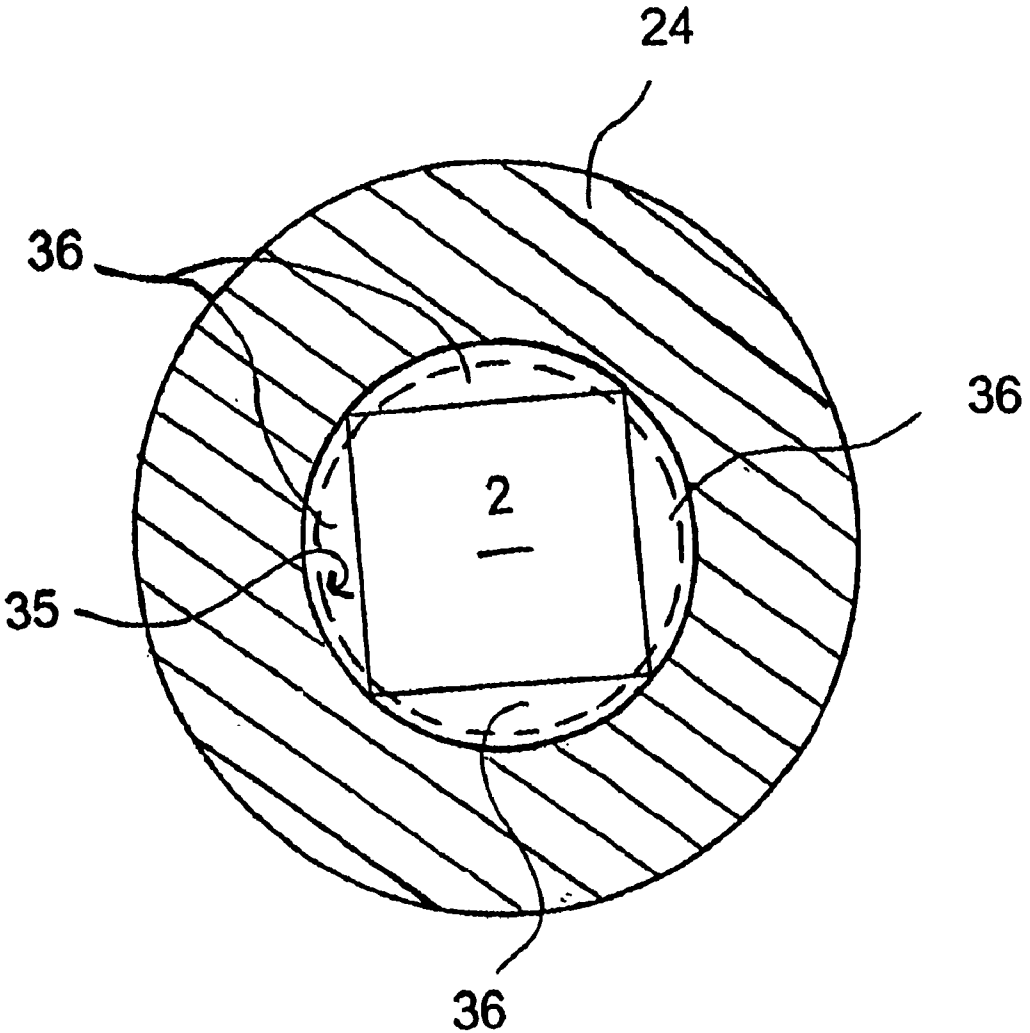
FIG. 7 is a diagrammatic cross-sectional view of the loaded gun barrel along section line 7—7 of FIG. 5.

Due to the square or rectangular shape of the leading end wall 4 of the premeasured compressed charge, the surface area of the leading end wall 4 of the premeasured compressed charge 2 is smaller than the surface area of a typical circular or cylindrical compressed charge, which is shown in dashed lines as element 35 in FIG. 7. That is, the square leading end wall 2 has a surface area of 0.101 square inches (for a square with a 0.45 inch diagonal) while a circular end wall has a surface area of 0.159 square inch (for a circle with a 0.45 diameter). In addition, the surface area of the four sidewalls 8, 9 of the premeasured compressed charge 2 is greater than the exposed surface area for a cylindrical pellet having an identical diameter and similar grain, i.e., the surface area for the four sidewalls is 1.358 square inches, for a premeasured compressed charge 2 having a 0.45 inch diagonal along the leading end wall, a 0.510 inch diagonal along the trailing end wall and 1.0 axial length, while the surface area for a cylindrical pellet is 1.159 square inches, for a pellet having a 0.45 inch diagonal along the leading end wall, and a 0.82 length. The charge designs, according to the present invention, increases the exposed sidewall surface area by about 5–20 percent or so depending upon the particular charge design.

The smaller surface area of the rectangular square end wall 4 facilitates passage or propagation of the flame, generated by detonation of the percussion cap or other ignition device, around the edges 10 of the leading end wall 4 through the four passageways 36 and into the four pockets 38 extending along the exposed sidewalls 8, 9 of the premeasured compressed charge (see FIGS. 5 and 7). As a result of the configuration of the charge, propagation of the flame and burning of the charge is facilitated not only axially along the premeasured compressed charge, i.e., from the leading end wall 4 toward the trailing end wall 6, but also burning of the charge is facilitated radially inwardly from each one of the four sidewalls toward the center of the premeasured compressed charge 2. The passageways 36 and pockets 38 facilitate propagation of the flame along the sidewalls 8, 9 to promote radially inward burning of the charge. This compressed charge design results in a more complete burning of the premeasured compressed charge and minimizes or prevents any rocketing of the premeasured compressed charge 2, which remains unburned upon discharge of the projectile 26 from the breech end of the firearm. A complete burning of the premeasured compressed charge 2 also facilitates generation of less unburned components or constituents which may remain in the firearm following discharge of the projectile 26.

A typical completely loaded position of the bullet or projectile 26 and premeasured compressed charge 2 is shown in FIG. 5.

The inventors believe that the increase in the exposed surface area of the compressed premeasured compressed charge 2, over pellets previously produced in the United States and Europe, for example, facilitates a more complete and rapid burning of the premeasured compressed charge 2 following discharge of the firearm. Such complete and rapid burning of the premeasured compressed charge 2 results in a minimal amount of unburned residue remaining in the firearm following discharge thereof. Due to the more complete burning of the premeasured compressed charge 2, e.g., the powder, it is less likely that any excessive residue or contaminant(s) will remain in the firearm, following discharge thereof, so that when a subsequent charge is loaded in the firearm, there is only a minimal or insubstantial amount of residue or contaminant(s) remaining which can be dislodged from the bore of the barrel and clog the flash channel that supplies the flame from the percussion cap or other ignition device to ignite the premeasured compressed charge 2, e.g., the gun powder charge, contained within the breech end 28 of the barrel 22.

Figure 10:
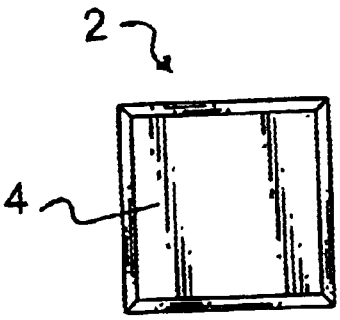
FIG. 10 is a diagrammatic front elevational view of the premeasured compressed charge of FIG. 8.
Figure 9:
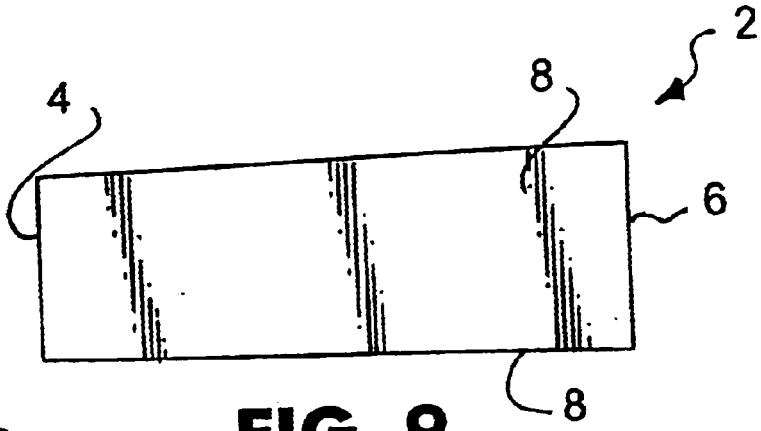
FIG. 9 is a diagrammatic side elevational view of the premeasured compressed charge of FIG. 8.
Figure 8:
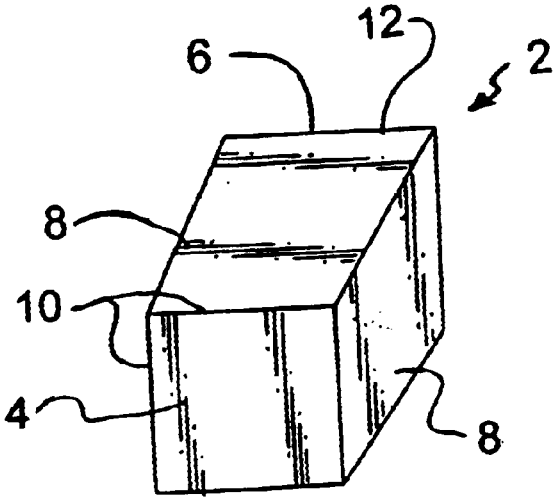
FIG. 8 is a diagrammatic perspective view of a second embodiment of a premeasured compressed charge according to the present invention.
Figure 13:
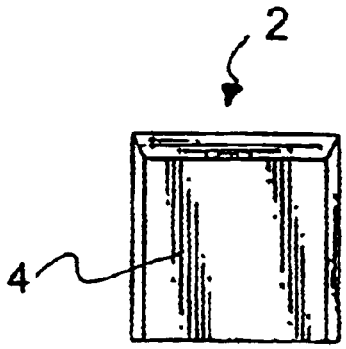
FIG. 13 is a diagrammatic front elevational view of the premeasured compressed charge of FIG. 11.
Figure 12:
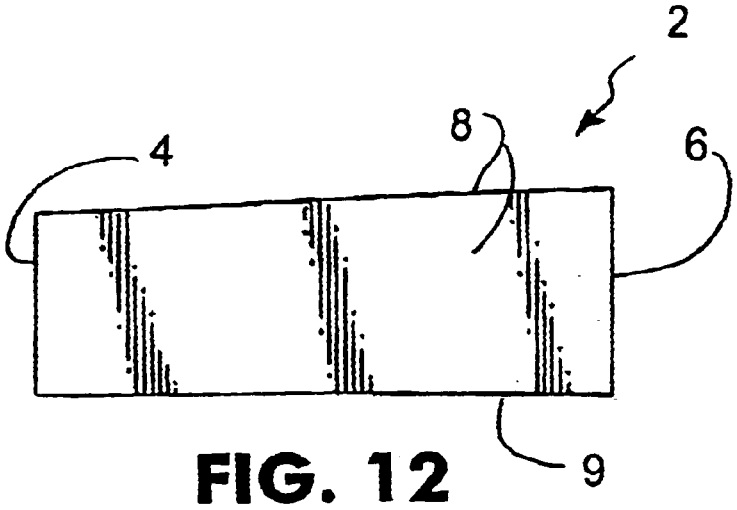
FIG. 12 is a diagrammatic side elevational view of the premeasured compressed charge of FIG. 11.
Figure 11:
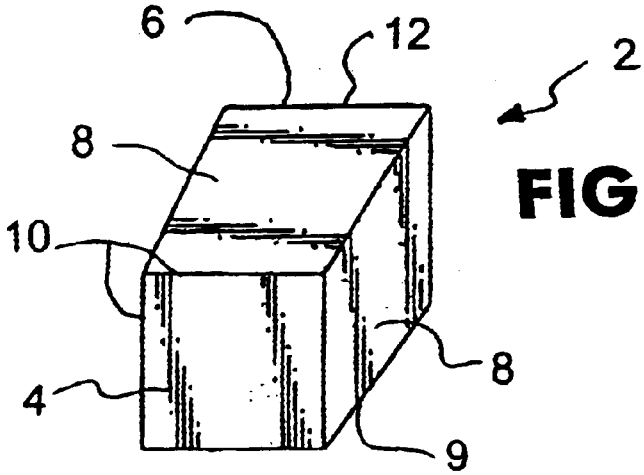
FIG. 11 is a diagrammatic perspective view of a third embodiment of a premeasured compressed charge according to the present invention.
Figure 14:
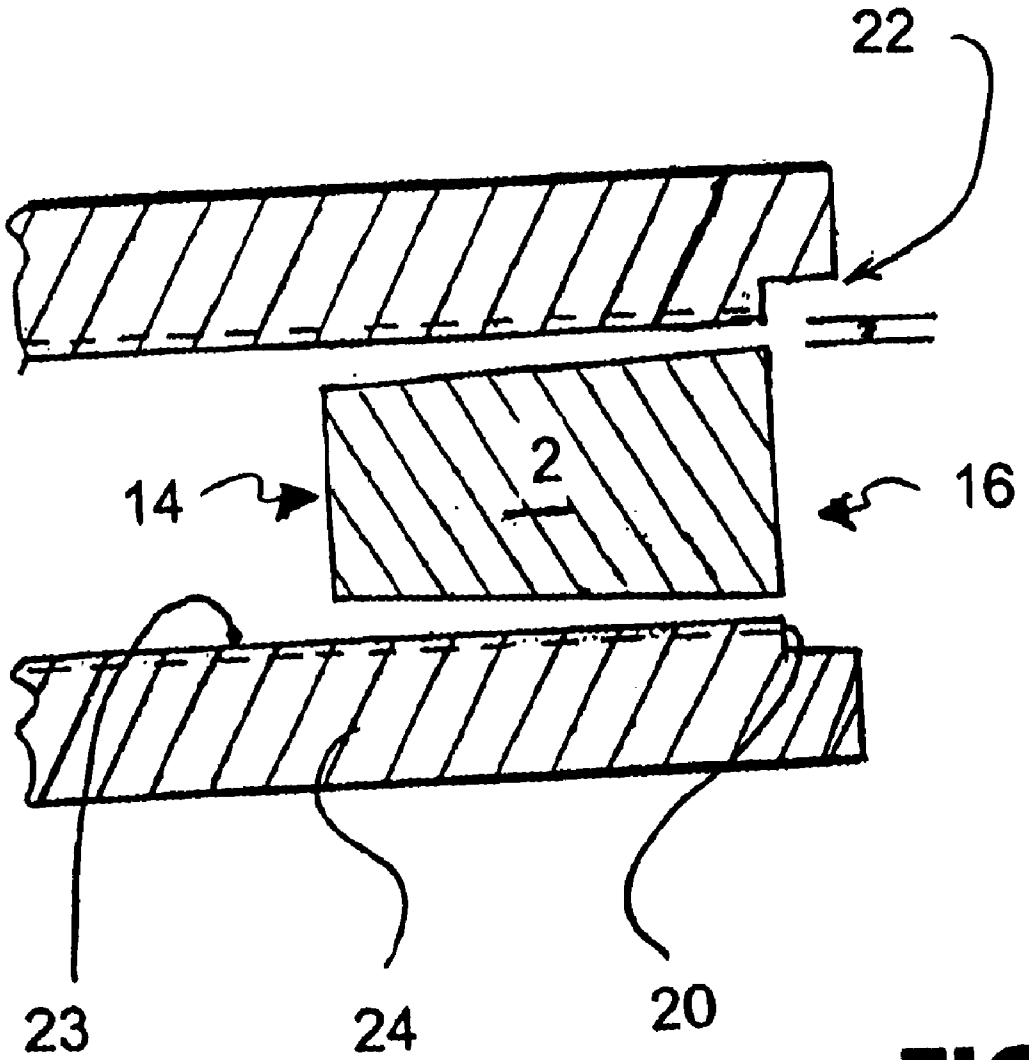
FIG. 14 diagrammatically shows the initially loaded position of the third embodiment of the premeasured compressed charge of FIG. 11 in the muzzle end of the barrel.

Turning now to FIGS. 8–10, a second embodiment of the improved premeasured compressed charge 2 can be seen. As this embodiment is very similar to the first embodiment, the same reference numerals are given the same elements and only the differences between this embodiment and the previous embodiment will be discussed.

The premeasured compressed charge 2 generally comprises, as with the previous embodiment, a pair of substantially planar end walls 4, 6 which are both generally rectangular or square in shape. The leading end wall 4 has a dimension which is less than the inside diameter of the barrel for which it is designed, e.g., undersized by about 0.060 of an inch or so, that is, for a 50-caliber barrel the leading end wall 4 has a diagonal measurement of approximately 0.440 inches, while the trailing end wall 6 has a dimension which is also less than the inside diameter of the barrel for which it is designed, e.g., undersized by about 0.010 inch, that is, for a 50-caliber barrel the trailing end wall 6 has a diagonal measurement of approximately 0.490 inch. Four substantially planar and slightly tapering sidewalls 8 interconnect a common perimeter region or edge 10 of the leading end wall 4 with a common region or edge 12 of the trailing end wall 6.

Turning now to FIGS. 11–14, a third embodiment of the improved premeasured compressed charge 2 can be seen. As this embodiment is very similar to the second embodiment, the same reference numerals are given the same elements and only the differences between this embodiment and the previous embodiments will be discussed.

The premeasured compressed charge 2 generally comprises, as with the second embodiment, a pair of substantially planar end walls 4, 6 which are both generally rectangular or square in shape. The leading end wall 4 has a dimension which is less than the inside diameter of the barrel for which it is designed, e.g., undersized by about 0.060 of an inch or so, that is, for a 50-caliber barrel the leading end wall 4 has a diagonal measurement of approximately 0.440 inches, while the trailing end wall 6 has a dimension which is also less than the inside diameter of the barrel for which it is designed, e.g., undersized by 0.010 inch, that is, for a 50-caliber barrel the trailing end wall 6 has a diagonal measurement of approximately 0.490 inch. As with the first embodiment, three substantially planar and slightly tapering sidewalls 8 interconnect a common perimeter region or edge 10 of the leading end wall 4 with a common region or edge 12 of the trailing end wall 6. A fourth substantially planar sidewall 9 interconnects the remaining region or edge 10 of the leading end wall 4 with the remaining region or edge 12 of the trailing end wall 6. The fourth substantially planar sidewall 9 does not taper in this embodiment and lies normal to both the leading end wall 4 and the trailing end wall 6.

When an end user places the premeasured compressed charge 2, according to the second or third embodiment, within the muzzle end 22 of the barrel (see FIG. 14), both the leading end portion 14 of the premeasured compressed charge 2 are undersized and are readily received therein without any interference occurring between the trailing edge end portion 16 of the premeasured compressed charge 2 and the annular perimeter edge surface 20 of the muzzle end 22 of the barrel 24. Thus, no powder is removed or shaved off from the premeasured compressed charge 2 during insertion thereof as with the previous embodiment and the premeasured compressed charge 2 can readily fall freely toward the breech end 28 of the barrel solely due to the force of gravity. Finally, a desired bullet or projectile 26, and if necessary a sabot or patch (wad), are inserted within the muzzle end 28 of the barrel and "rammed" toward the breech end 28 of the barrel 22 to ensure that the leading end wall of the propellant charge 2 is positioned adjacent the outlet 31 of the flash channel 32. In all other respects this embodiment is the same as the previous embodiment.

Figure 17:
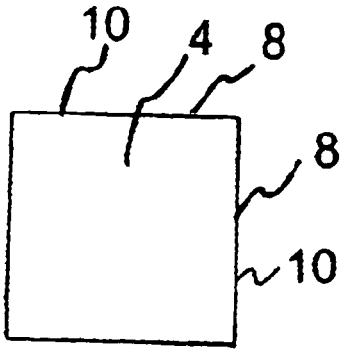
FIG. 17 is a diagrammatic front elevational view of the premeasured compressed charge of FIG. 15.
Figure 16:
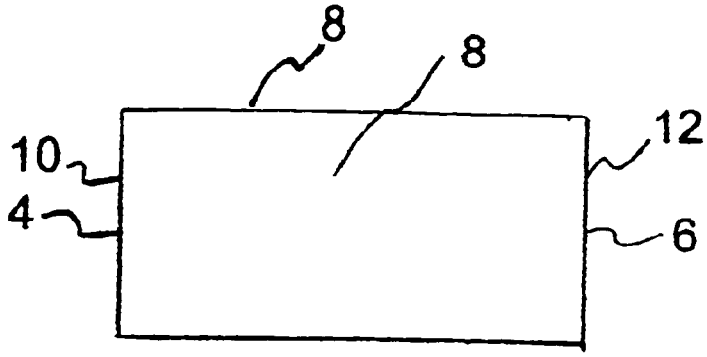
FIG. 16 is a diagrammatic side elevational view of the premeasured compressed charge of FIG. 15.
Figure 15:
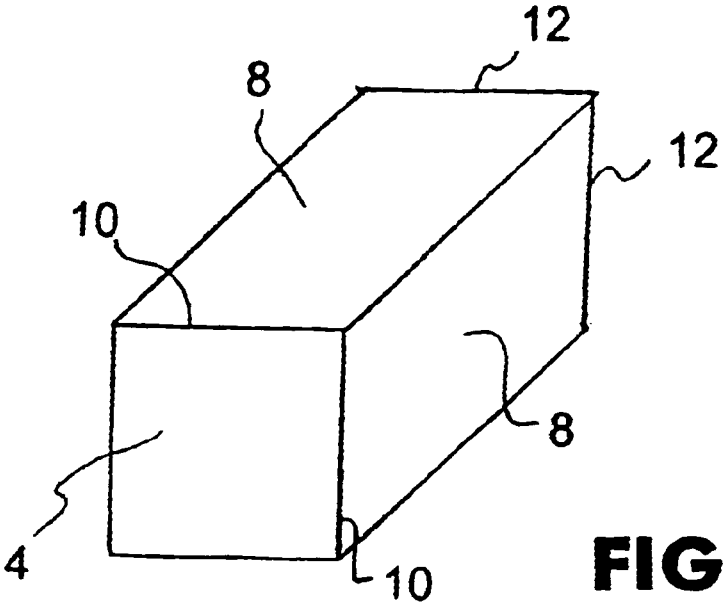
FIG. 15 is a diagrammatic perspective view of a fourth embodiment of a premeasured compressed charge according to the present invention.

Turning now to FIGS. 15–17, a fourth embodiment of the improved premeasured compressed charge 2 can be seen. As this embodiment is very similar to the previous embodiments, the same reference numerals are given the same elements and only the differences between this embodiment and the previous embodiments will be discussed.

As with the previous embodiments, the premeasured compressed charge 2 generally comprises a pair of substantially planar end walls 4, 6 which are both generally rectangular or square in shape. Both the leading end wall 4 and the trailing end wall 6 have a dimension which is less than the inside diameter of the barrel for which it is designed, e.g., undersized by about 0.060 of an inch or so. That is, for a 50-caliber barrel, the end walls 4, 6 each have a diagonal measurement of approximately 0.440 inches. Four substantially planar sidewalls 8 interconnect a common perimeter region or edge 10 of the leading end wall 4 with a common region or edge 12 of the trailing end wall 6. None of the sidewalls 8 taper and each one of the sidewalls 8 extends normal to both the leading end wall 4 and the trailing end wall 6.

Figure 18:
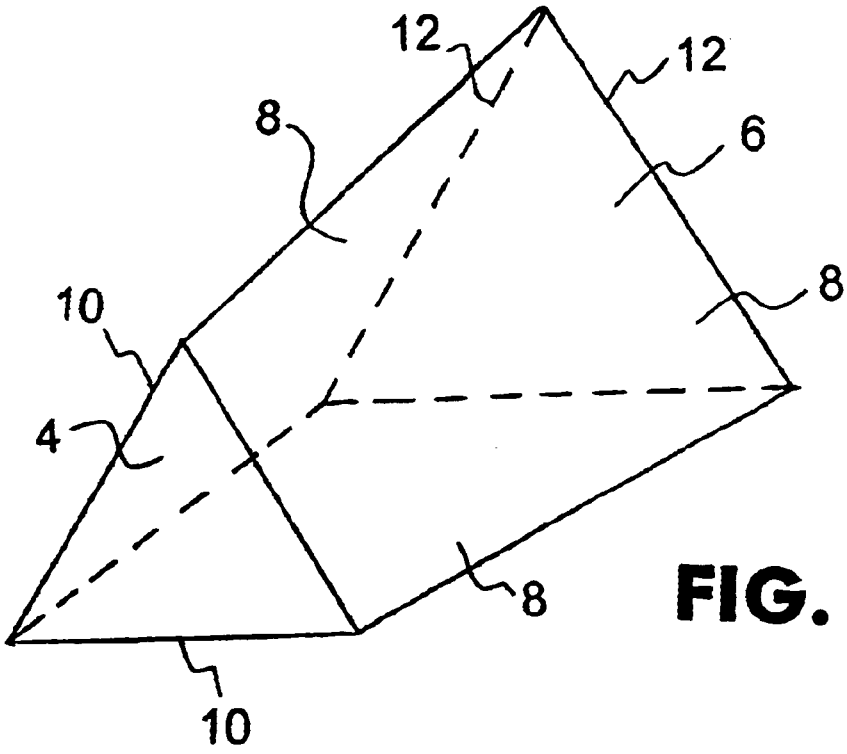
FIG. 18 is a diagrammatic perspective view of a fifth embodiment of a premeasured compressed charge, according to the present invention, with tapering sidewalls.
Figure 18A:
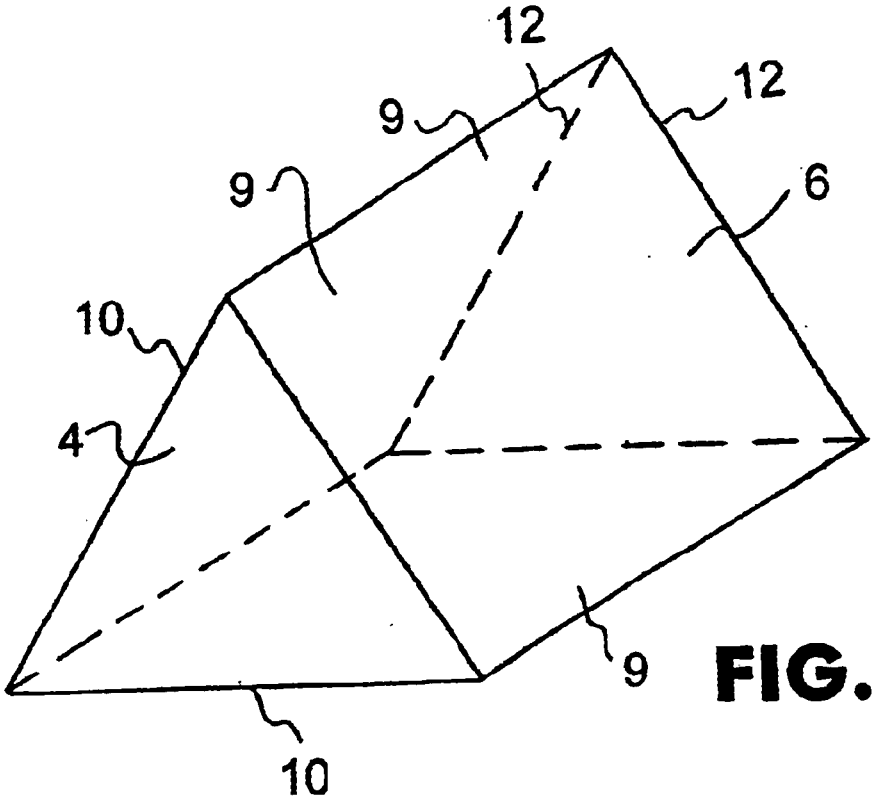
FIG. 18A is a diagrammatic perspective view of the fifth embodiment of a premeasured compressed charge with parallel sidewalls.

With reference to FIGS. 18 and 18A, a fifth embodiment of the improved premeasured compressed charge 2 can be seen. As this embodiment is very similar to the previous embodiments, the same reference numerals are given the same elements and only the differences between this embodiment and the previous embodiments will be discussed. As with the previous embodiments, the premeasured compressed charge 2 generally comprises a pair of substantially planar end walls 4, 6, but the end walls 4, 6 are both generally triangular in shape.

In FIG. 18, the leading end wall 4 is smaller in dimension than the trailing end wall 6 and three substantially planar and tapering sidewalls 8 interconnect a common perimeter region or edge 10 of the leading end wall 4 with a common perimeter region or edge 12 of the trailing end wall 6. That is, each one of the three tapering sidewalls 8 forms an acute angle with the trailing end wall 6 and forms an obtuse angle with the leading end wall 4. Typically the leading end wall 4 has a dimension which is less than the inside diameter of the barrel for which premeasured compressed charge 2 is designed while the trailing end wall 6 typically has a dimension greater than the inside diameter of the barrel for which premeasured compressed charge 2 is designed, although it is conceivable that both the leading and trailing end walls 4, 6 can be dimensioned less than the inside diameter of the barrel for which premeasured compressed charge 2 is designed.

In FIG. 18A, the leading end wall 4 and the trailing end wall 6 are substantially the same size and both have a dimension which is less than the inside diameter of the barrel for which the premeasured compressed charge 2 is designed. The three substantially planar sidewalls 9 interconnect a common perimeter region or edge 10 of the leading end wall 4 with a common perimeter region or edge 12 of the trailing end wall 6. None of the sidewalls 9 taper and each one of the sidewalls 9 extends normal with both the leading end wall 4 and the trailing end wall 6. Typically both the leading and the trailing end walls 4, 6 have dimensions which are less than the inside diameter of the barrel for which the premeasured compressed charge 2 is designed, although it is conceivable that both the leading and trailing end walls 4, 6 can be dimensioned slightly greater, e.g., by a few thousands of an inch or so, than the inside diameter of the barrel for which premeasured compressed charge 2 is designed.

Figure 19:
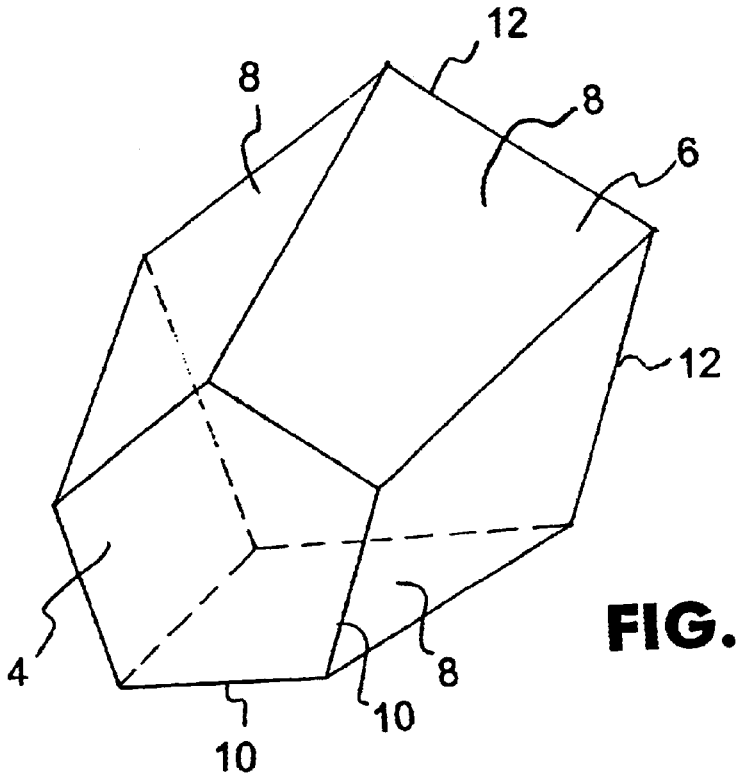
FIG. 19 is a diagrammatic perspective view of a sixth embodiment of a premeasured compressed charge according to the present invention with tapering sidewalls.
Figure 19A:
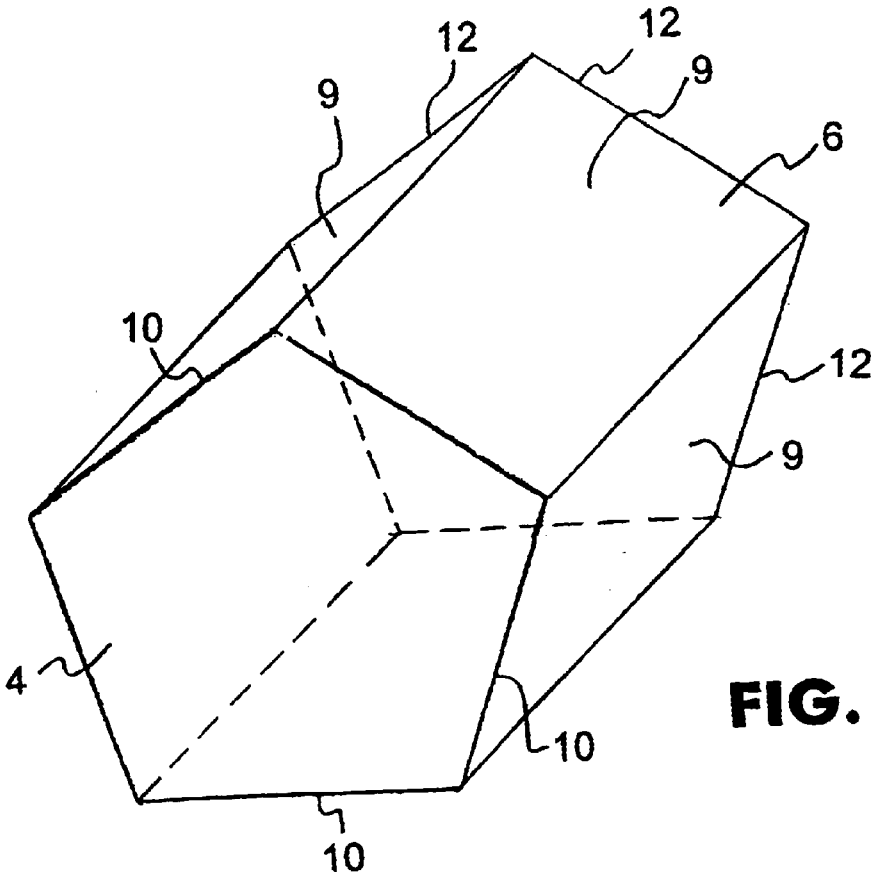
FIG. 19A is a diagrammatic perspective view of the sixth embodiment of a premeasured compressed charge with parallel sidewalls.

With reference to FIGS. 19 and 19A, a sixth embodiment of the improved premeasured compressed charge 2 can be seen. As this embodiment is very similar to the previous embodiments, the same reference numerals are given the same elements and only the differences between this embodiment and the previous embodiments will be discussed. As with the previous embodiments, the premeasured compressed charge 2 generally comprises a pair of substantially planar end walls 4, 6, but the end walls 4, 6 are both generally pentagonal in shape.

In FIG. 19, the leading end wall 4 is smaller in dimension than the trailing end wall 6 and five substantially planar and tapering sidewalls 8 interconnect a common perimeter region or edge 10 of the leading end wall 4 with a common perimeter region or edge 12 of the trailing end wall 6. That is, each one of the five tapering sidewalls 8 forms an acute angle with the trailing end wall 6 and forms an obtuse angle with the leading end wall 4. Typically the leading end wall 4 has a dimension which is less than the inside diameter of the barrel for which premeasured compressed charge 2 is designed while the trailing end wall 6 typically has a dimension greater than the inside diameter of the barrel for which premeasured compressed charge 2 is designed, although it is conceivable that both the leading and trailing end walls 4, 6 can be dimensioned less than the inside diameter of the barrel for which premeasured compressed charge 2 is designed.

In FIG. 19A, the leading end wall 4 and the trailing end wall 6 are substantially the same size and both have a dimension which is less than the inside diameter of the barrel for which the premeasured compressed charge 2 is designed. The five substantially planar sidewalls 9 interconnect a common perimeter region or edge 10 of the leading end wall 4 with a common perimeter region or edge 12 of the trailing end wall 6. None of the sidewalls 9 taper and each one of the sidewalls 9 extends normal with both the leading end wall 4 and the trailing end wall 6. Typically both the leading and the trailing end walls 4, 6 have dimensions which are less than the inside diameter of the barrel for which the premeasured compressed charge 2 is designed, although it is conceivable that both the leading and trailing end walls 4, 6 can be dimensioned slightly greater, e.g., by a few thousands of an inch or so, than the inside diameter of the barrel for which premeasured compressed charge 2 is designed.

Figure 20:
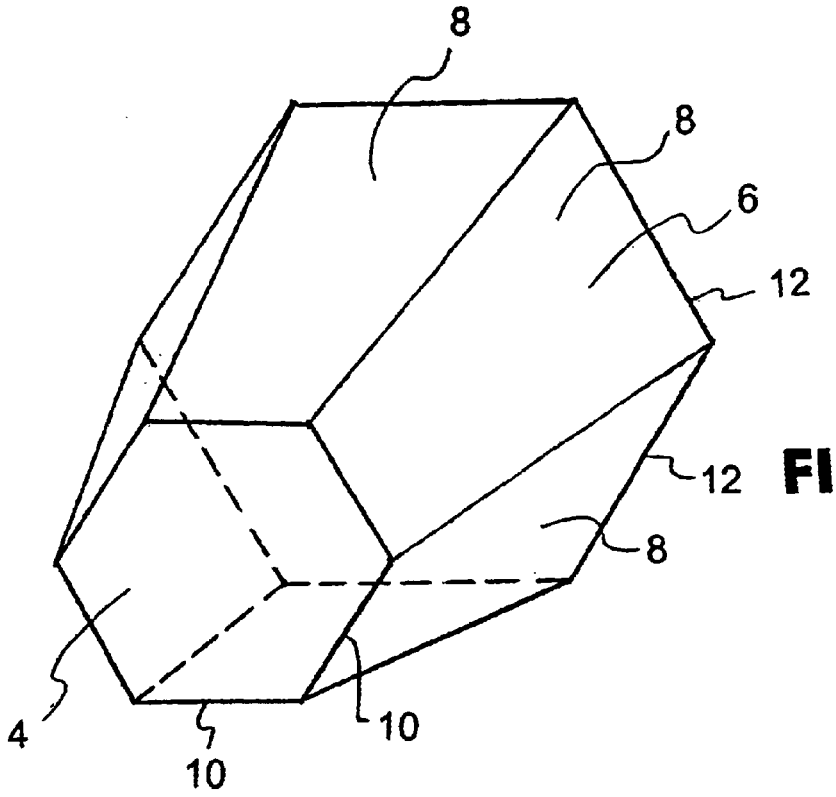
FIG. 20 is a diagrammatic perspective view of a seventh embodiment of a premeasured compressed charge, according to the present invention, with tapering sidewalls.
Figure 20A:
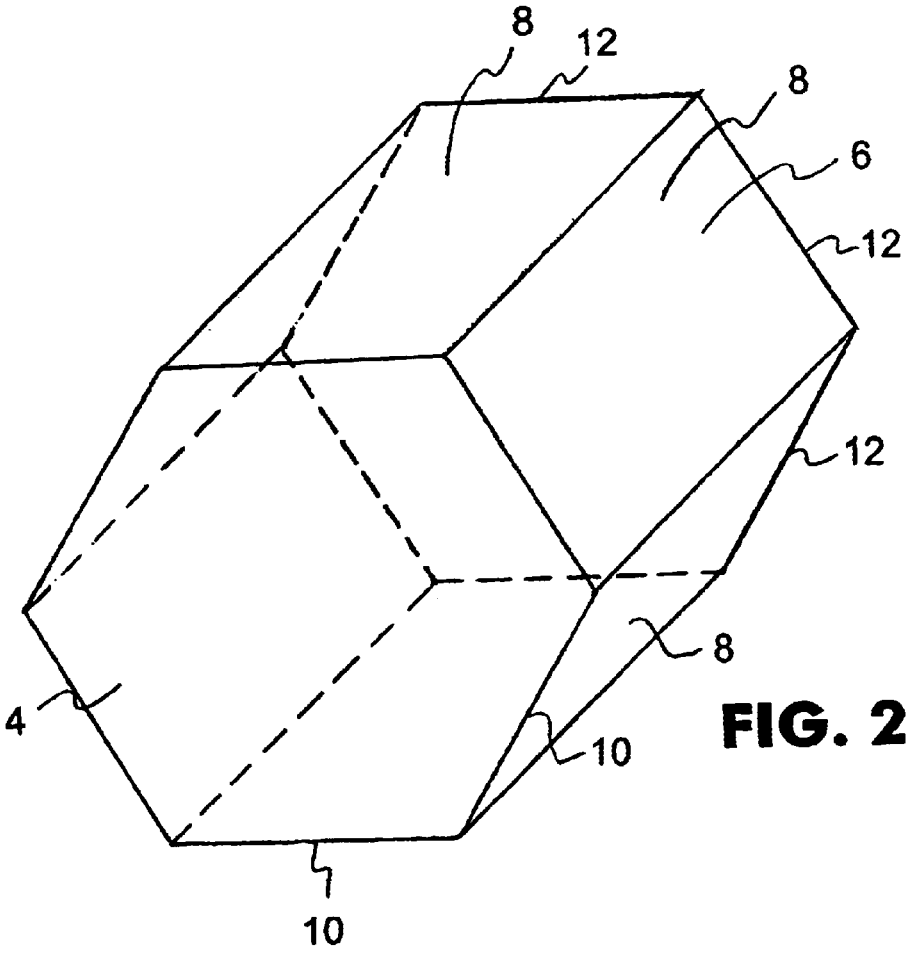
FIG. 20A is a diagrammatic perspective view of the seventh embodiment of a premeasured compressed charge with parallel sidewalls.

With reference to FIGS. 20 and 20A, a seventh embodiment of the improved premeasured compressed charge 2 can be seen. As this embodiment is very similar to the previous embodiments, the same reference numerals are given the same elements and only the differences between this embodiment and the previous embodiments will be discussed. As with the previous embodiments, the premeasured compressed charge 2 generally comprises a pair of substantially planar end walls 4, 6, but the end walls 4, 6 are both generally hexagonal in shape.

In FIG. 20, the leading end wall 4 is smaller in dimension than the trailing end wall 6 and six substantially planar and tapering sidewalls 8 interconnect a common perimeter region or edge 10 of the leading end wall 4 with a common perimeter region or edge 12 of the trailing end wall 6. That is, each one of the six tapering sidewalls 8 forms an acute angle with the trailing end wall 6 and forms an obtuse angle with the leading end wall 4. Typically the leading end wall 4 has a dimension which is less than the inside diameter of the barrel for which premeasured compressed charge 2 is designed while the trailing end wall 6 typically has a dimension greater than the inside diameter of the barrel for which premeasured compressed charge 2 is designed, although it is conceivable that both the leading and trailing end walls 4, 6 can be dimensioned less than the inside diameter of the barrel for which premeasured compressed charge 2 is designed.

In FIG. 20A, the leading end wall 4 and the trailing end wall 6 are substantially the same size and both have a dimension which is less than the inside diameter of the barrel for which the premeasured compressed charge 2 is designed. The six substantially planar sidewalls 9 interconnect a common perimeter region or edge 10 of the leading end wall 4 with a common perimeter region or edge 12 of the trailing end wall 6. None of the sidewalls 9 taper and each one of the sidewalls 9 extends normal with both the leading end wall 4 and the trailing end wall 6. Typically both the leading and the trailing end walls 4, 6 have dimensions which are less than the inside diameter of the barrel for which the premeasured compressed charge 2 is designed, although it is conceivable that both the leading and trailing end walls 4, 6 can be dimensioned slightly greater, e.g., by a few thousands of an inch or so, than the inside diameter of the barrel for which premeasured compressed charge 2 is designed.

Figure 21:
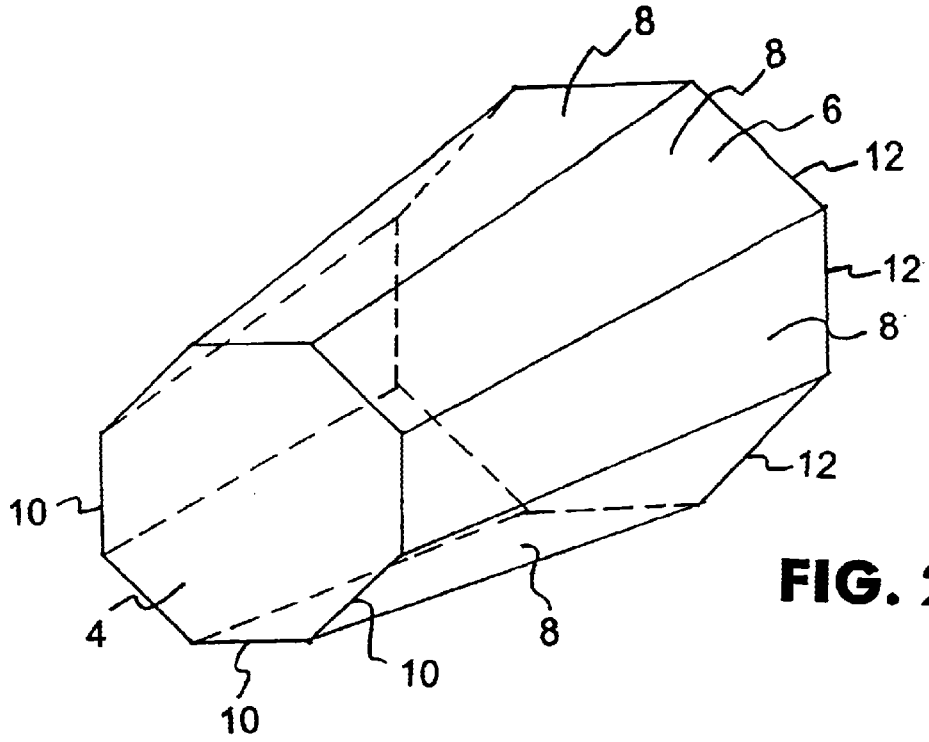
FIG. 21 is a diagrammatic perspective view of an eight embodiment of a premeasured compressed charge according to the present invention with tapering sidewalls.
Figure 21A:
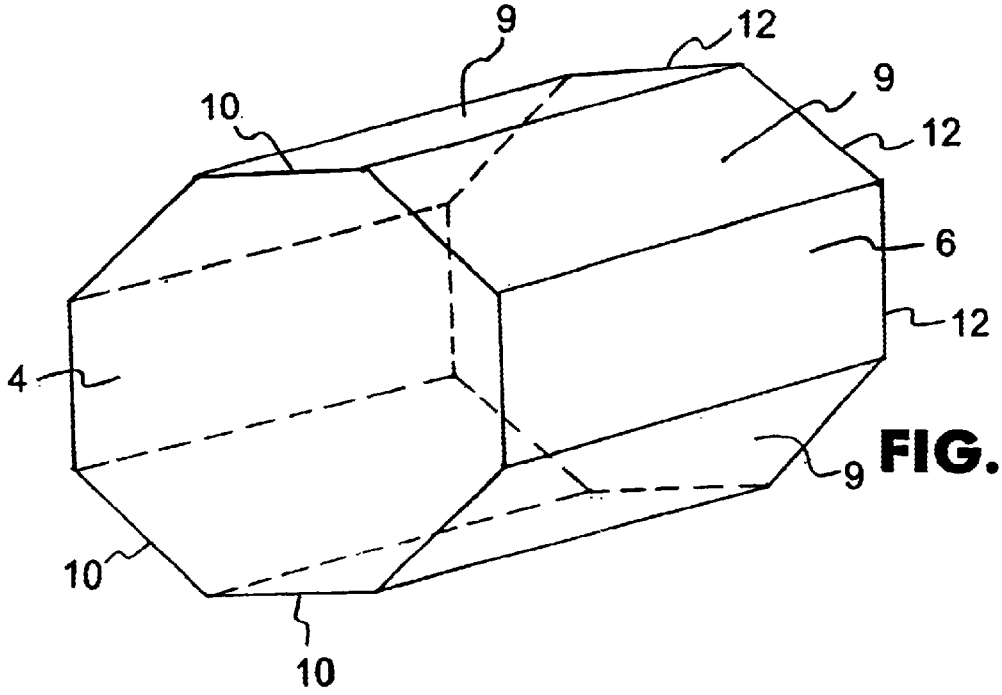
FIG. 21A is a diagrammatic perspective view of the eight embodiment of a premeasured compressed charge with parallel sidewalls.

With reference to FIGS. 21 and 21A, an eighth embodiment of the improved premeasured compressed charge 2 can be seen. As this embodiment is very similar to the previous embodiments, the same reference numerals are given the same elements and only the differences between this embodiment and the previous embodiments will be discussed. As with the previous embodiments, the premeasured compressed charge 2 generally comprises a pair of substantially planar end walls 4, 6, but the end walls 4, 6 are both generally octagonal in shape.

In FIG. 21, the leading end wall 4 is smaller in dimension than the trailing end wall 6 and eight substantially planar and tapering sidewalls 8 interconnect a common perimeter region or edge 10 of the leading end wall 4 with a common perimeter region or edge 12 of the trailing end wall 6. That is, each one of the eight tapering sidewalls 8 forms an acute angle with the trailing end wall 6 and forms an obtuse angle with the leading end wall 4. Typically the leading end wall 4 has a dimension which is less than the inside diameter of the barrel for which premeasured compressed charge 2 is designed while the trailing end wall 6 typically has a dimension greater than the inside diameter of the barrel for which premeasured compressed charge 2 is designed, although it is conceivable that both the leading and trailing end walls 4, 6 can be dimensioned less than the inside diameter of the barrel for which premeasured compressed charge 2 is designed.

In FIG. 21A, the leading end wall 4 and the trailing end wall 6 are substantially the same size and both have a dimension which is less than the inside diameter of the barrel for which the premeasured compressed charge 2 is designed. The eight substantially planar sidewalls 9 interconnect a common perimeter region or edge 10 of the leading end wall 4 with a common perimeter region or edge 12 of the trailing end wall 6. None of the sidewalls 9 taper and each one of the sidewalls 9 extends normal with both the leading end wall 4 and the trailing end wall 6. Typically both the leading and the trailing end walls 4, 6 have dimensions which are less than the inside diameter of the barrel for which the premeasured compressed charge 2 is designed, although it is conceivable that both the leading and trailing end walls 4, 6 can be dimensioned slightly greater, e.g., by a few thousands of an inch or so, than the inside diameter of the barrel for which premeasured compressed charge 2 is designed.

Figure 22:
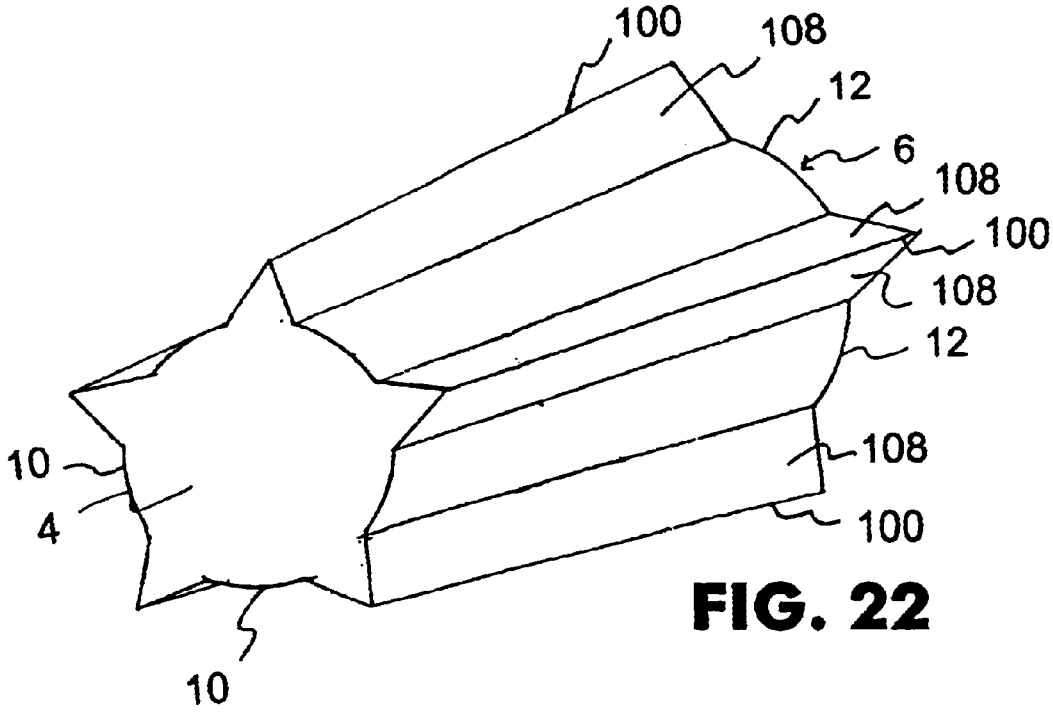
FIG. 22 is a diagrammatic perspective view of a ninth seventh embodiment of a premeasured compressed charge, according to the present invention, with tapering sidewalls.
Figure 22A:
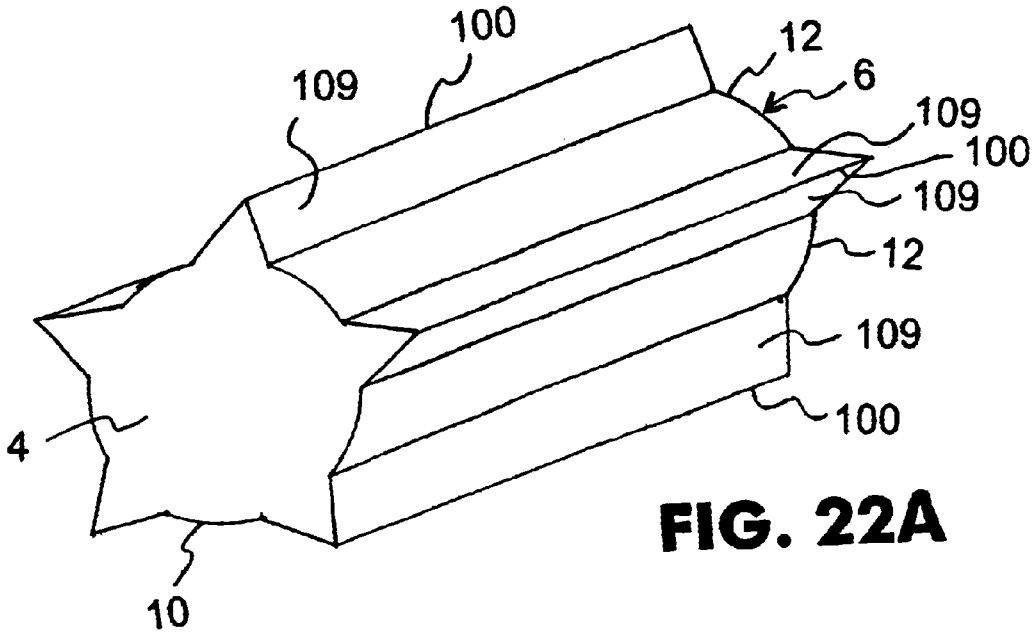
FIG. 22A is a diagrammatic perspective view of the ninth embodiment of a premeasured compressed charge with parallel sidewalls.

With reference to FIGS. 22 and 22A, a ninth embodiment of the improved premeasured compressed charge 2 can be seen. As this embodiment is very similar to the previous embodiments, the same reference numerals are given the same elements and only the differences between this embodiment and the previous embodiments will be discussed. As with the previous embodiments, the premeasured compressed charge 2 generally comprises a pair of substantially planar end walls 4, 6, but the end walls 4, 6 are both generally star or asterisk in shape and a majority of the gun powder is located in a central region or area of the premeasured compressed charge 2.

In FIG. 22, the leading end wall 4 is smaller in dimension than the trailing end wall 6 and five pairs of substantially planar sidewalls 108 interconnect a common perimeter region or edge 10 of the leading end wall 4 with a common perimeter region or edge 12 of the trailing end wall 6. That is, a remote end of each pair of sidewalls 108 intersect one another and from and elongate ridge 100 and each one of the five ridges 100 tapers and forms an acute angle with the trailing end wall 6 and forms an obtuse angle with the leading end wall 4. Typically the leading end wall 4 has a dimension which is less than the inside diameter of the barrel for which premeasured compressed charge 2 is designed while the trailing end wall 6 typically has a dimension greater than the inside diameter of the barrel for which premeasured compressed charge 2 is designed, although it is conceivable that both the leading and trailing end walls 4, 6 can be dimensioned less than the inside diameter of the barrel for which premeasured compressed charge 2 is designed.

In FIG. 22A, the leading end wall 4 and the trailing end wall 6 are substantially the same size and both have a dimension which is less than the inside diameter of the barrel for which the premeasured compressed charge 2 is designed. Five pairs of substantially planar sidewalls 109 interconnect a common perimeter region or edge 10 of the leading end wall 4 with a common perimeter region or edge 12 of the trailing end wall 6. A remote end of each pair of sidewalls 109 intersect one another and from and elongate ridge 100. None of the five ridges 100 taper and each one of the five ridges 100 extends normal with both the leading end wall 4 and the trailing end wall 6. Typically both the leading and the trailing end walls 4, 6 have dimensions which are less than the inside diameter of the barrel for which the premeasured compressed charge 2 is designed, although it is conceivable that both the leading and trailing end walls 4, 6 can be dimensioned slightly greater, e.g., by a few thousands of an inch or so, than the inside diameter of the barrel for which premeasured compressed charge 2 is designed. It is to be appreciated that while the star is shown as having five pairs of substantially planar sidewalls 108 interconnect a common perimeter region or edge 10 of the leading end wall 4 with a common perimeter region or edge 12 of the trailing end wall 6, the number of pairs of substantially planar sidewalls 108 can be increased of decreased as desired depending upon the particular application.

One known method for producing gun powder, suitable for use in manufacturing the premeasured compressed charge 2, is disclosed in U.S. Pat. No. 5,557,151 and such teaching is incorporated herein by reference. The only substantive modification to the teachings and disclosures of this incorporated reference is that, according to the present invention, some of potassium nitrate is replaced by potassium perchlorate.

One method of manufacturing the compressed charge of the present invention is to start with a suitable gun powder, for example, gun powder manufactured in accordance with U.S. Pat. No. 5,557,151, black powder, a black powder substitute or smokeless gun powder. If the gun powder is too big or clumpy, the size of the gun powder can be reduced to a desired size, e.g., be reduced to a particle size between 1 micron and ¼ inch, for example. It is to be appreciated that the gun powder, utilized to form the compressed charge according to the present invention, may have a range of particle sizes. Moreover, in some applications, it is desirable or beneficial to utilize gun powder having more than one particle size, e.g., gun powder having a range of particle sizes. After the sizing step, the gun powder is then thoroughly blended together in a ball mill, a hammer mill, or some other conventional or suitable mixing apparatus to form a uniform mixture of the gun powder. The mixing step is particularly important if the employed gun powder has more than one particle size or a range of particle sizes. Following the mixing step, sufficient moisture is added to the gun powder, if necessary, so that the uniform mixture of gun powder incorporates between 0.01 to 10.0 percent by weight of moisture. If it is desirable to form the compressed charges without pressure, the uniform mixture of gun powder must have a moisture content of greater than 10.0 percent by weight, i.e., turning the gun powder into a slurry, pouring the slurry into a mold, and allowing the slurry to dry and form the compressed charge. The moistened uniform mixture of gun powder is then placed into a mold of a desired size and shape before the gun powder is compressed. It is recommended to use a mold that allows many charges to be compressed in a single pressure stroke, unless a continuous process is being utilized (i.e., an extruder or rotary press, for example). Typically a pressure between 1 and 50,000 psi, preferably between 5 and 5,000 psi, of pressure is applied to the gun powder in the mold to form the desired compressed charge. After the compressed charge is sufficiently compressed in the form into its desired shape, the compressed charge is then removed from the form and placed in a dryer, or some other moisture removing device, to remove excess moisture. It is to be appreciated that the drying or moisture removing step may not be critical and may be eliminated in some applications. The drying step, if employed, typically reduces the moisture content of compressed charge to a desired level, e.g., between 0.1 and 5.0 percent by weight, depending on the particular application. Finally, the compressed charges are packed in a desired package or container and the packaged product is then ready for shipment.

It is to be appreciated that while the above discussion contemplates the premeasured compressed charge to be inserted from the muzzle end of the firearm, it is also within the spirit and scope of the present invention to insert the projectile from the breech end of the barrel, and such insertion is then followed by insertion of the premeasured compressed charge, and a sabot or patch (wad) if necessary, in the breech end of the barrel. Thereafter, the firearm can be discharged in a conventional manner. Alternatively, the premeasured compressed charge can be used in a black powder firearms, such as a multiple shot pistol, or a variety of other conventional and well known firearms currently available on the market. The premeasured compressed charge is also suitable to be loaded in a cartridge for manufacture of a conventional casing which has a percussion cap incorporated in a base of the cartridge.

While the present invention has been described with reference to a propellant charge having a triangular, rectangular, pentagonal, hexagonal, octagonal, star or asterisk transverse cross section, it is to be appreciated that the propellant charge may have a variety of other polygon cross section such as, for example, a heptagonal transverse cross section, a decagon transverse cross section, etc., without departing from the spirit and scope of the present invention.

Since certain changes may be made in the above described improved premeasured compressed charge, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. An improved premeasured compressed charge for use with a black powder firearm having a desired caliber of an intended firearm, the premeasured compressed charge having a leading end portion and a trailing end portion, the leading end portion having a smaller dimension than both the trailing end portion and the desired caliber of the intended firearm, while the trailing end portion having a larger diagonal dimension than the desired caliber of the firearm such that the leading end portion of the premeasured compressed charge is readily received within the desired caliber of the firearm while the trailing end portion must be forced into the desired caliber of the firearm;

wherein the leading end portion of the premeasured compressed charge is located closely adjacent an outlet of the flash channel of the firearm, following loading of the premeasured compressed charge within the firearm, and the leading end portion facilitates flame propagation of the flame along sidewalls of the premeasured compressed charge, generated upon detonation of an ignition device, to facilitate the more complete combustion of the premeasured compressed charge and less rocketing of the premeasured compressed charge following discharge of the projectile from a muzzle end of the firearm.

2. The premeasured compressed charge according to claim 1, wherein the premeasured compressed charge has an axial length of between one-half inch and one and one-half inches.

3. The premeasured compressed charge according to claim 1, wherein at least the trailing end portion of the premeasured compressed charge has an interference fit with the muzzle end of the desired barrel so as to require force to insert the premeasured compressed charge completely into a breech end of the barrel.

4. The premeasured compressed charge according to claim 3, wherein the interference fit of the premeasured compressed charge is at least 0.001 of an inch.

5. The premeasured compressed charge according to claim 1, wherein at least three of the sidewalls of the premeasured compressed charge taper outwardly from the leading end portion toward the trailing end portion of the premeasured compressed charge.

6. The premeasured compressed charge according to claim 4, wherein at least three of the sidewalls of the premeasured compressed charge taper outwardly from the leading end portion toward the trailing end portion of the premeasured compressed charge.

7. The premeasured compressed charge according to claim 1, wherein four of the sidewalls of the premeasured compressed charge taper outwardly from the leading end portion toward the trailing end portion of the premeasured compressed charge.

8. The premeasured compressed charge according to claim 1, wherein an end wall of the leading end portion and an end wall of the trailing end portion are both generally square in shape.

9. The premeasured compressed charge according to claim 1, wherein the premeasured compressed charge, upon insertion into a desired caliber firearm, has four small triangular wedge-shaped sections which have an interference fit with an internal diameter of the bore of the firearm, and the four small triangular wedge-shaped sections are shaven off from the premeasured compressed charge during insertion of the premeasured compressed charge into the bore of the barrel.

10. The premeasured compressed charge according to claim 9, wherein at least a portion of the shaved off four small triangular wedge-shaped sections tend to fall, by gravity, toward the outlet of the flash channel and facilitate the better flame propagation upon detonation of an ignition device.

11. The premeasured compressed charge according to claim 1, wherein the diagonal dimension of the leading end portion is between 0.31 of an inch and 0.53 of an inch and the diagonal dimension of the trailing end portion is between 0.37 of an inch and 0.59 of an inch.

12. The premeasured compressed charge according to claim 1, wherein the premeasured compressed charge comprises a mixture of:

15–35% by weight of potassium perchlorate;

25–50% by weight of potassium nitrate;

25–50% by weight of a fuel component; and

0–5% by weight of charcoal.

13. The premeasured compressed charge according to claim 12, wherein the fuel component is selected from the carbohydrate family.

14. The premeasured compressed charge according to claim 12, wherein the fuel component is selected from the group comprising at least one of the following: amino acid, ascorbic acid, sugar, starch, and carbon.

15. The premeasured compressed charge according to claim 6, wherein the premeasured compressed charge comprises a mixture of:

15–35% by weight of potassium perchlorate;

25–50% by weight of potassium nitrate;

25–50% by weight of a fuel component; and

0–5% by weight of charcoal.

16. The premeasured compressed charge according to claim 15, wherein the fuel component is selected from the carbohydrate family.

17. The premeasured compressed charge according to claim 15, wherein the fuel component is selected from the group comprising at least one of the following: amino acid, ascorbic acid, sugar, starch, and carbon.

18. The premeasured compressed charge according to claim 1, wherein the premeasured compressed charge comprises a mixture of:

50–75% by weight of potassium nitrate;

25–50% by weight of a fuel component; and

0–5% by weight of charcoal.

19. The premeasured compressed charge according to claim 18, wherein the fuel component is selected from the carbohydrate family.

20. The premeasured compressed charge according to claim 18, wherein the fuel component is selected from the group comprising at least one of the following: amino acid, ascorbic acid, sugar, starch, and carbon.

21. The premeasured compressed charge according to claim 1, wherein the premeasured compressed charge has opposed ends which are one of triangular, rectangular, pentagonal, hexagonal, octagonal, star and asterisk shaped.

22. An improved premeasured compressed charge for use with a black powder firearm having a desired caliber of an intended firearm, the premeasured compressed charge having a leading end portion and a trailing end portion, the leading end portion having a smaller diagonal dimension than both the trailing end portion and the desired caliber of the intended firearm, while the trailing end portion having a larger diagonal dimension than the desired caliber of the firearm such that the leading end portion of the premeasured compressed charge is readily received within the desired caliber of the firearm while the trailing end portion must be forced into the desired caliber of the firearm;

wherein the leading end portion of the premeasured compressed charge is located closely adjacent an outlet of the flash channel of the firearm, following loading of the premeasured compressed charge within the firearm, and the leading end portion facilitates flame propagation of the flame along sidewalls of the premeasured compressed charge, generated upon detonation of an ignition device, to facilitate the more complete combustion of the premeasured compressed charge and less rocketing of the premeasured compressed charge following discharge of the projectile from a muzzle end of the firearm;

at least three of the sidewalls of the premeasured compressed charge taper outwardly from the leading end portion toward the trailing end portion of the premeasured compressed charge; and an end wall of the leading end portion and an end wall of the trailing end portion are both generally square in shape.

23. The premeasured compressed charge according to claim 22, wherein the compressed charge has an axial length of between one-half inch and one and one-half inches.

24. The premeasured compressed charge according to claim 23, wherein the premeasured compressed charge comprises a mixture of:

15–35% by weight of potassium perchlorate;

25–50% by weight of potassium nitrate;

25–50% by weight of a fuel component; and

0–5% by weight of charcoal.

25. The premeasured compressed charge according to claim 24, wherein the fuel component is selected from the carbohydrate family.

26. The premeasured compressed charge according to claim 24, wherein the fuel component is selected from the group comprising at least one of the following: amino acid, ascorbic acid, sugar, starch, and carbon.

27. The premeasured compressed charge according to claim 23, wherein the premeasured compressed charge comprises a mixture of:

50–75% by weight of potassium nitrate;

25–50% by weight of a fuel component; and

0–5% by weight of charcoal.

28. The premeasured compressed charge according to claim 27, wherein the fuel component is selected from the carbohydrate family.

29. The premeasured compressed charge according to claim 27, wherein the fuel component is selected from the group comprising at least one of the following: amino acid, ascorbic acid, sugar, starch, and carbon.

30. The premeasured compressed charge according to claim 23, wherein the diagonal dimension of the leading end portion is between 0.31 of an inch and 0.53 of an inch and the diagonal dimension of the trailing end portion is between 0.37 of an inch and 0.59 of an inch.

31. The premeasured compressed charge according to claim 22, wherein the premeasured compressed charge has opposed ends which are one of triangular, rectangular, pentagonal, hexagonal, octagonal, star and asterisk shaped.

32. An improved premeasured compressed charge for use with a black powder firearm having a desired caliber of an intended firearm, the premeasured compressed charge having a leading end portion and a trailing end portion;

wherein the leading end portion of the premeasured compressed charge is located closely adjacent an outlet of the flash channel of the firearm, following loading of the premeasured compressed charge within the firearm, and the leading end portion facilitates flame propagation of the flame along sidewalls of the premeasured compressed charge, generated upon detonation of an ignition device, to facilitate the more complete combustion of the premeasured compressed charge and less rocketing of the premeasured compressed charge following discharge of the projectile from a muzzle end of the firearm.

33. The premeasured compressed charge according to claim 32, wherein the leading end portion has a similar dimension to the trailing end portion and both the leading and the trailing end portions have a smaller dimension than the desired caliber of the intended firearm such that both the leading end portion and the trailing end portion of the premeasured compressed charge are received within the desired caliber of the firearm.

34. The premeasured compressed charge according to claim 32, wherein the leading end portion has a smaller dimension than both the trailing end portion and the desired caliber of the intended firearm, while the trailing end portion has a smaller dimension than the desired caliber of the intended firearm such that both the leading end portion and the trailing end portion of the premeasured compressed charge are received within the desired caliber of the firearm.

35. The premeasured compressed charge according to claim 32, wherein the leading end portion has a similar dimension than both the trailing end portion and the desired caliber of the intended firearm, and the trailing end portion has a larger dimension than the desired caliber of the intended firearm such that the trailing end portion of the premeasured compressed charge must be forced in a barrel of the desired caliber of the firearm.

36. The premeasured compressed charge according to claim 32, wherein the premeasured compressed charge has opposed ends which are one of triangular, rectangular, pentagonal, hexagonal, octagonal, star and asterisk shaped.

37. The premeasured compressed charge according to claim 33, wherein the premeasured compressed charge has opposed ends which are one of triangular, rectangular, pentagonal, hexagonal, octagonal, star and asterisk shaped.

* * * * *